US011661758B2

(12) United States Patent
Walter

(10) Patent No.: US 11,661,758 B2
(45) Date of Patent: May 30, 2023

(54) REUSABLE MOLD FOR FORMING SWIMMING POOL COPINGS

(71) Applicant: Gregory Walter, Shorewood, IL (US)

(72) Inventor: Gregory Walter, Shorewood, IL (US)

( * ) Notice: Subject to any disclaimer, the term of this patent is extended or adjusted under 35 U.S.C. 154(b) by 295 days.

(21) Appl. No.: 17/062,901

(22) Filed: Oct. 5, 2020

(65) Prior Publication Data

US 2022/0106801 A1 Apr. 7, 2022

(51) Int. Cl.
*E04H 4/14* (2006.01)
*E04G 13/06* (2006.01)

(52) U.S. Cl.
CPC ..... *E04H 4/141* (2013.01); *E04G 13/066* (2013.01)

(58) Field of Classification Search
CPC ... E04G 13/066; E04G 13/064; E04G 13/062; E04G 13/06; E04G 13/00; E04H 4/141
See application file for complete search history.

(56) References Cited

U.S. PATENT DOCUMENTS 3,776,501 A * 12/1973 Loftin ..... E04H 4/141 249/2
3,868,797 A * 3/1975 Fox ..... E04G 13/06 52/73
3,904,717 A * 9/1975 Stegmeier ..... E04H 4/141 249/19
4,318,254 A * 3/1982 Stegmeier ..... E04H 4/0081 52/741.12
4,395,014 A * 7/1983 Deason ..... E04H 4/141 249/19
4,625,343 A * 12/1986 Bumgarner, Sr. ..... E04H 4/141 249/DIG. 3
4,641,465 A * 2/1987 Boyle ..... E04H 4/141 249/207
9,476,215 B2 * 10/2016 Baldoni ..... E04H 4/141
9,574,358 B2 * 2/2017 Deason ..... E04G 13/06
10,100,544 B2 * 10/2018 Crocker ..... E04H 4/142
10,794,074 B2 * 10/2020 Baldoni ..... E04H 4/141
(Continued)

FOREIGN PATENT DOCUMENTS

DE 1684195 A1 * 4/1971 ..... E04G 13/066
DE 102009014858 A1 * 10/2010 ..... E01D 19/106
(Continued)

*Primary Examiner* — Michael Safavi
(74) *Attorney, Agent, or Firm* — Donald G. Flaynik

(57) ABSTRACT

A reusable pool mold for forming a swimming pool coping or overhang above a peripheral portion of pool water in accordance with the present invention includes multiple bracket members detachably secured to a liner receiver for a swimming pool. Each bracket having a lower portion of an outer vertical member integrally joined to an outer portion of a horizontal member, and having an inner portion of said horizontal member integrally joined to an upper portion of an inner vertical member. Each bracket member includes a securing member for detachably securing a bracket member to the liner receiver. The pool mold includes a form member that continuously extends above a water portion of a swimming pool; the form member receiving deformable material that ultimately solidifies, whereupon, the form member and brackets are removed from the solidified material to reveal a configured coping or overhang continuously extending above a peripheral portion of water inside the swimming pool.

20 Claims, 21 Drawing Sheets

(56) References Cited

U.S. PATENT DOCUMENTS

| | | | | |
|---|---|---|---|---|
| 2005/0011153 | A1* | 1/2005 | Stegmeier | E04H 4/141<br>52/396.05 |
| 2021/0331347 | A1* | 10/2021 | Glentz | B28B 7/225 |

FOREIGN PATENT DOCUMENTS

| | | | | |
|---|---|---|---|---|
| DK | 162785 | B * | 12/1991 | E04G 13/066 |
| FR | 2648850 | A1 * | 12/1990 | E04H 4/141 |

* cited by examiner

REUSABLE MOLD FOR FORMING SWIMMING POOL COPINGS

BACKGROUND OF THE INVENTION

1. Field of the Invention

This invention relates to reusable mold for forming swimming pool copings. Swimming pool copings include a lip portion that enables the coping to cover the exposed top surface of pool walls and to protect the wall by directing water away from the pool interior and into a deck drain, thereby preventing water from penetrating behind pool walls. Further, swimming pool copings includes a finished surface that enable a swimmer to grab something when exiting a swimming pool. Swimming pool copings can be formed that extend over a predetermined peripheral portion of water (an "overhang") adjacent to the pool wall; whereby, a walking area around the periphery of a swimming pool is formed that supports a swimmer above water.

2. Background of the Prior Art

Concrete form assemblies for forming copings or "overhangs" for a swimming pool are well known. In particular, U.S. Pat. No. 10,358,836 ("836") provides a molding system for swimming pool copings that includes a plurality of molding platforms and molding blocks disposed upon the molding platform; whereby, the molding platforms and molding blocks extend continuously about the periphery of a swimming pool, resulting in the platforms and blocks forming a continuously extending mold that ultimately receives a deformable material that solidifies to form a coping having a predetermined configuration.

The molding platforms of the 836 Patent further includes lips integrally joined to mold supports that support the molding blocks above swimming pool water. The lips "pinch" a receiver track that extends substantially along the entire periphery of swimming pool, thereby maintaining the position of the molding platforms relative to the receiver track. The molding platforms also include back panels detachably secured to the mold supports. The back panels maintain the horizontal position of the molding blocks upon the mold supports when a deformable material engages the molding blocks. A unique tool ultimately removes the molding system from solidified deformable material and the receiver track.

The problem with the 836 Patent is that the molding system requires molding platforms and molding blocks that continuously extend about the periphery of a swimming pool; lips that pinch (but do not "lock" upon) a receiver track to maintain the position of the molding platforms relative to the receiver track; and requires a special tool to remove the molding system from the receiver track and deformable material.

A need exists for a reusable mold for forming swimming pool copings that includes a predetermined quantity of brackets that support forms for configuring pool copings; the brackets including locking members that removably secure the brackets to a cooperating liner receiver that continuously extends about a swimming pool. The brackets include members that enable the brackets to be removed from the liner receivers without using a special tool. Further, a need exits for a reusable mold for forming swimming pool copings and/or overhangs that cooperate with a corresponding bracket retainer secured to a concrete surface disposed about the periphery of the swimming pool. The quantity of brackets equals the quantity of bracket retainers with both brackets and bracket retainer having substantially the same dimensions when taking a top view of adjacently disposed brackets and bracket retainers.

SUMMARY OF THE INVENTION

It is an object of the present invention is to provide a reusable mold for forming swimming pool copings. A principal object of the present invention is to provide a reusable mold for forming swimming pool copings; whereby, multiple separated reusable brackets support reusable forms that are disposed proximate to and extend continuously about a top surface of a swimming pool wall. A feature of the reusable mold is multiple brackets that are separated a distance between two and three feet about the perimeter of a swimming pool wall irrespective of the swimming pool having linear or arcuate pool walls forming the swimming pool. Another feature of the reusable mold is that the brackets are configured to detachably secure to an existing liner receiver that continuously extend about and secured to a rigid surface that continuously extends about the swimming pool. Still another feature of the reusable mold is that the brackets are configured to detachably secure to cooperating discrete bracket retainers having the same side view configuration as a liner receiver. An advantage of the reusable mold is that the brackets are manufactured from materials that do not degrade via engage with water and are "light" weight to minimize the force imparted upon the liner receivers. Another advantage of the reusable mold is that less material is required to fabricate the reusable mold than prior art devices, thereby reducing the weight of the reusable mold and corresponding costs to ship and install the reusable mold when compared to prior art devices.

Another object of the present invention is to provide multiple brackets with each bracket having an outer vertical plate member having a lower portion rotationally secured to an outer portion of a horizontal plate member via a hinge member that allows the outer vertical plate member to rotate relative to and distally separate from the horizontal plate member. A feature of the hinge member is that the outer vertical plate member is allowed to pivot one hundred and eighty degrees in a vertically downward position after removing a fastener that secures the outer vertical plate member to a vertical form member. An advantage of the downward position of the vertical plate member is that a vertical form member can be separated from a solidified deformable material that forms an outer vertical wall of the coping or overhang. Another advantage of the downward position is that a horizontal form member can be horizontally urged from between the solidified deformable material and the horizontal plate member after removing a fastener that secures the horizontal form member to the horizontal plate member, thereby revealing a horizontal bottom wall of the coping or overhang.

Still another object of the present invention is to provide a bracket having an inner portion of the horizontal plate member integrally joined to an upper portion of an inner vertical plate member; whereby, a substantially ninety-degree angle is formed between the horizontal plate member and the inner vertical plate member. A feature of the vertical plate member includes a relatively small horizontal portion integrally joined to a relatively rigid securing member fabricated from a relatively hard rubber having a right triangle configuration. An advantage of the securing member is that the triangular configuration and hard rubber fabrication material of the securing member promotes the insertion of the securing member inside a recess in the liner receiver, thereby removably attaching the securing member to the liner receiver and preventing the removal of the securing member from the liner receiver when the deformable material is disposed upon form members supported by the brackets. Another advantage of the securing member is that the fabrication material of the securing member enables the securing member to removably attached to the liner receiver irrespective of an end portion of a pool liner being disposed in the liner receiver. Yet another advantage of the securing member is that the securing member can be manually removed from the liner receiver after the deformable material has solidified, thereby enabling the bracket to be reused at another swimming pool location.

Yet another object of the present invention is to provide a bracket having a securing member that is disposed inside the recess; whereby, the securing member engages a portion of the liner receiver that locks the position of the securing member inside the recess. A feature of the horizontal portion of the vertical plate member and the securing member is cooperating dimensions that dispose a lower portion of the horizontal portion upon a top wall of a retaining jaw of the liner receiver, and simultaneously disposes a bottom wall of the securing member upon a bottom wall of the recess, resulting in the capture of the jaw member between a lower vertical wall of the securing member and the inner vertical plate member, and the congruent engage of the inner vertical plate member upon a vertical wall of the swimming pool. An advantage of the bracket is that the captured jaw member maintains the securing member inside the recess of the liner receiver and maintains the position of the reusable pool mold relative to the swimming pool wall when deformable material is disposed upon the reusable pool mold to form the coping or overhang over a selected peripheral portion of water in the swimming pool.

Another advantage of the bracket is that in the event an end portion of a pool liner is present in the liner receiver; whereby, a lower portion of the horizontal portion is not disposed upon a top wall of the jaw member, and/or the bottom wall of the securing member is not disposed upon the bottom wall of the recess, the relatively rigid but deformable securing member will remain removably attached to the liner receiver, the inner vertical plate member will congruently engage the vertical wall of the swimming pool, and the position of the bracket relative to the liner receiver and the vertical swimming pool wall will remain constant when deformable material is disposed form members supported by the brackets.

Another object of the present invention is to provide a form member detachably secured to the horizontal plate members of each bracket secured to liner receivers about the swimming pool. A feature of the form member is a horizontally positioned first form member that is fabricated from non-deformable material (wood, polymer or metal) capable of supporting a bottom portion of a deformable material (typically concrete). Another feature of the form member is a vertically positioned second form member fabricated from the same material as the first form member. Yet another feature of the form member is that it continually extends about a preselected peripheral portion of a swimming pool. An advantage of the horizontal first form member is that it engages the liner receiver whereby the deformable material is prevented from entering a securing member receiving recess in the liner receiver, thereby enabling the manual removal of the securing member from the recess. An advantage of the vertical second form member is that it may include a design in an inner wall that impresses a configuration in a corresponding outer vertical wall of deformable material that engages the design, thereby permanently including the design in the deformable material after solidifying. Yet another advantage of the form member is that it forms a continuously extending coping or overhang around a predetermined upper portion of a swimming pool.

Another principal object of the present invention is to provide a reusable mold for forming swimming pool overhangs; whereby, multiple separated reusable bracket members support reusable forms that are disposed proximate to and extend continuously about a top surface of a swimming pool wall. A feature of the reusable mold is multiple bracket members that are separated a distance between two and three feet about the perimeter of a swimming pool wall irrespective of the swimming pool having linear or arcuate pool walls forming the swimming pool. Another feature of the reusable mold is that the bracket members are configured to detachably secure to cooperating locking tab members, whereby, the bracket members and locking tab members are configured and dimensioned to correspond to the dimensions of an overhang, the weight of the deformable material disposed upon the forms supported by the bracket members and the distance between adjacent bracket members. An advantage of the reusable pool mold that includes multiple bracket members and cooperating locking tab members is that the bracket members are detachably secured to the locking members without the use of a deformable securing member.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
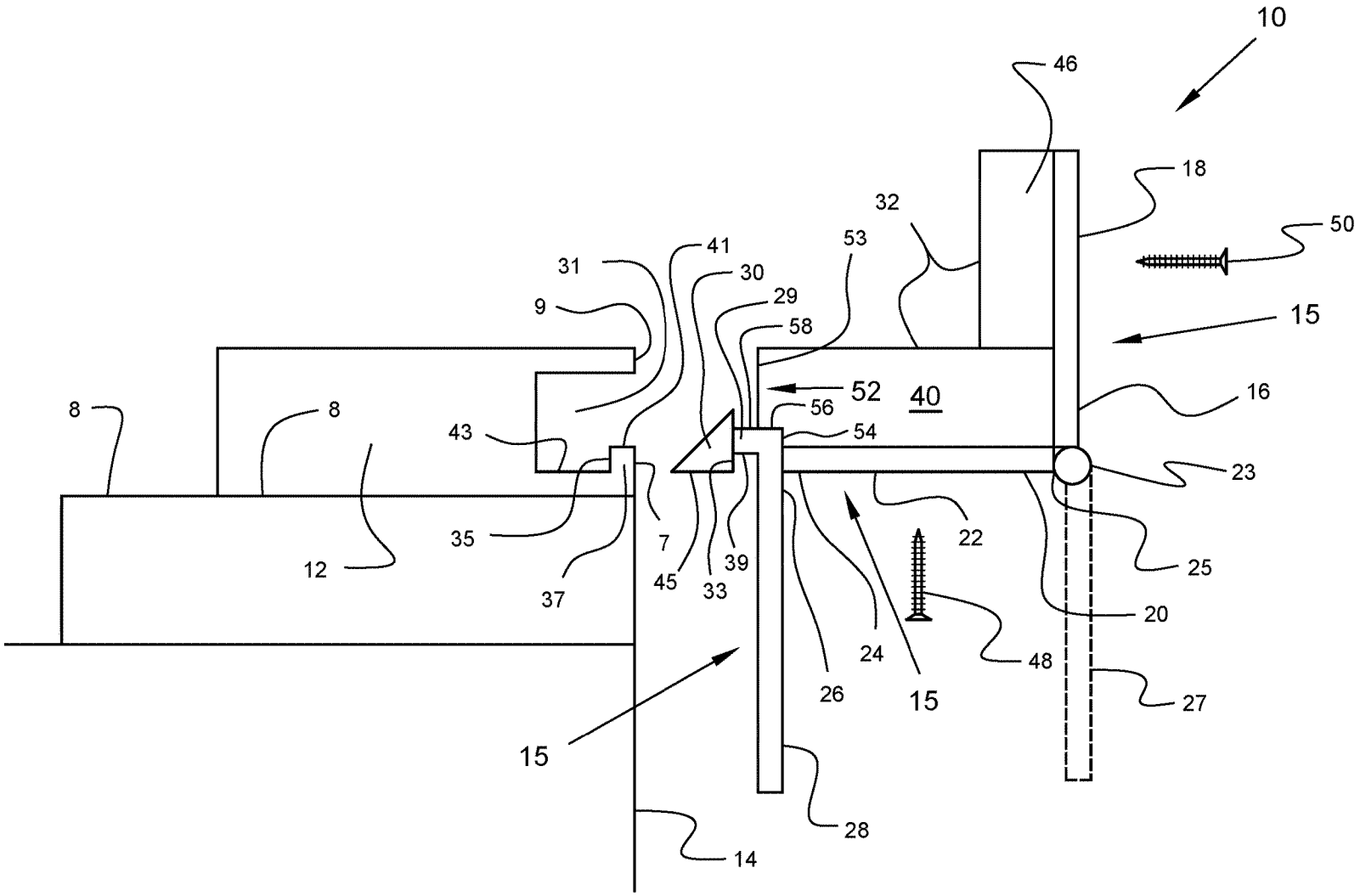
FIG. 1 is a left side elevation view of a reusable pool mold for forming a swimming pool overhang above a peripheral portion of pool water, the reusable pool mold is depicted adjacent to and separated from a pool liner receiver in accordance with the present invention.
Figure 2:
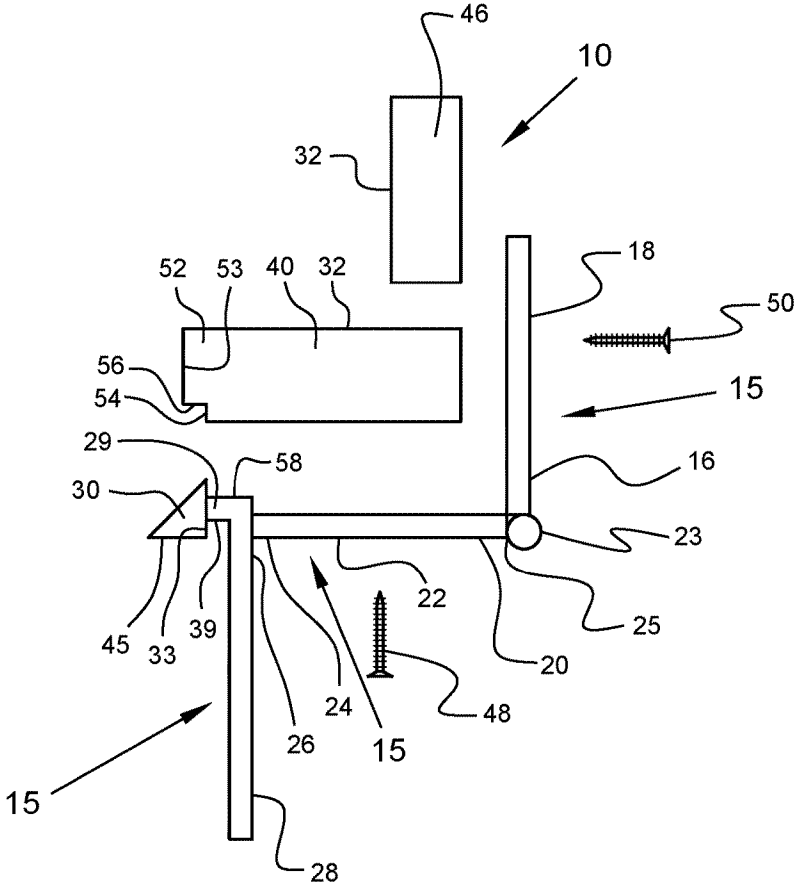
FIG. 2 is an exploded view of the reusable pool mold depicted in FIG. 1.
Figure 3:
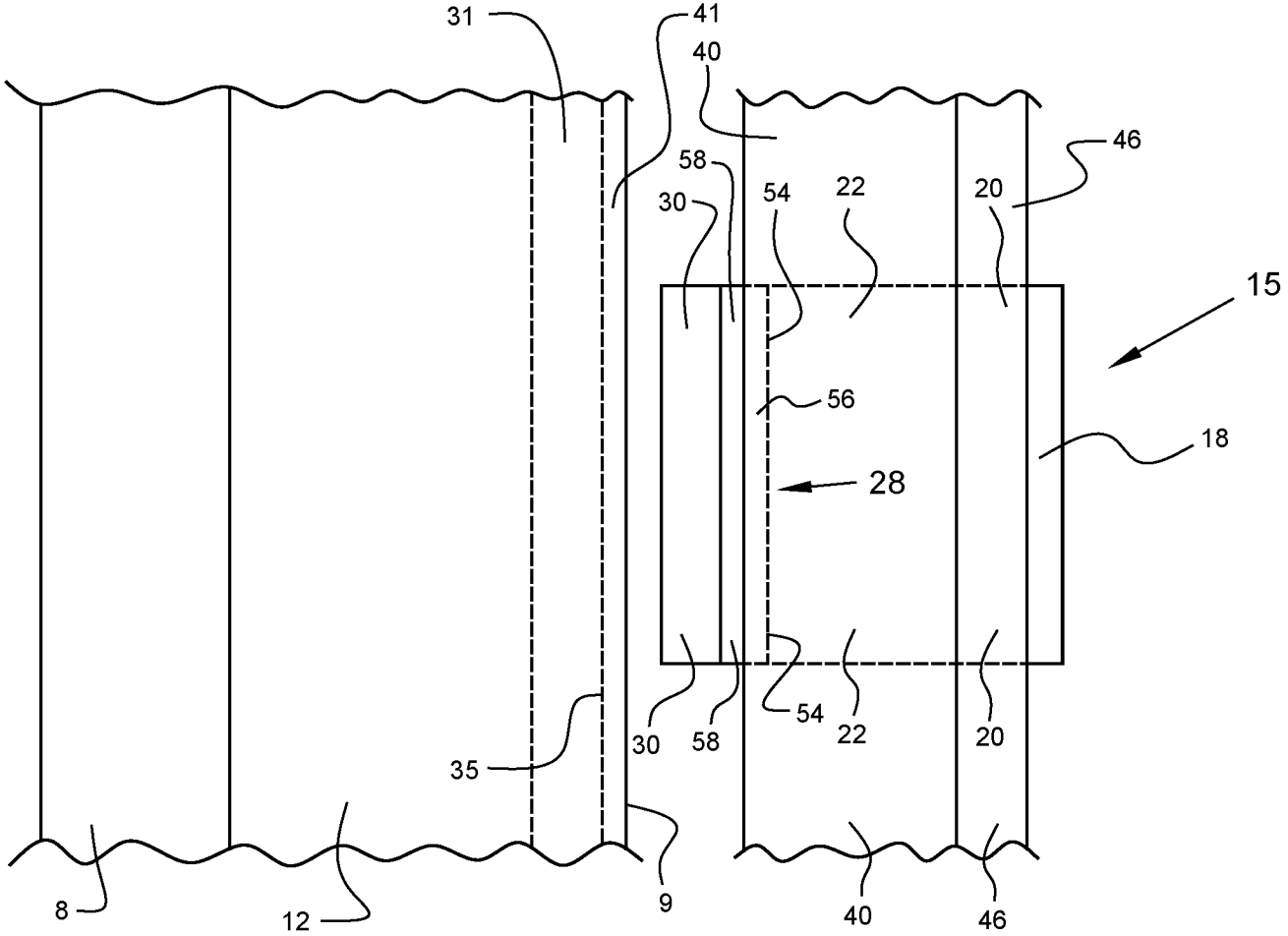
FIG. 3 is a top view of FIG. 1.

Referring now to FIGS. 1-7A, a reusable pool mold for forming an overhang 44 or coping above a peripheral portion of pool water in accordance with the present invention is depicted and is denoted as numeral 10. The reusable pool mold 10 is detachably secured to a preexisting liner receiver 12 (well known to those of ordinary skill in the art) or similarly configured device disposed upon a portion of concrete that forms a walking surface 8 contiguous with the periphery of a swimming pool 13. The liner receiver 12 is depicted without a pool liner being secured to the liner receiver 12; however, the use and operation of the reusable pool mold 10 remains consistent with or without a pool liner being secured to the liner receiver 12.

Figure 5:
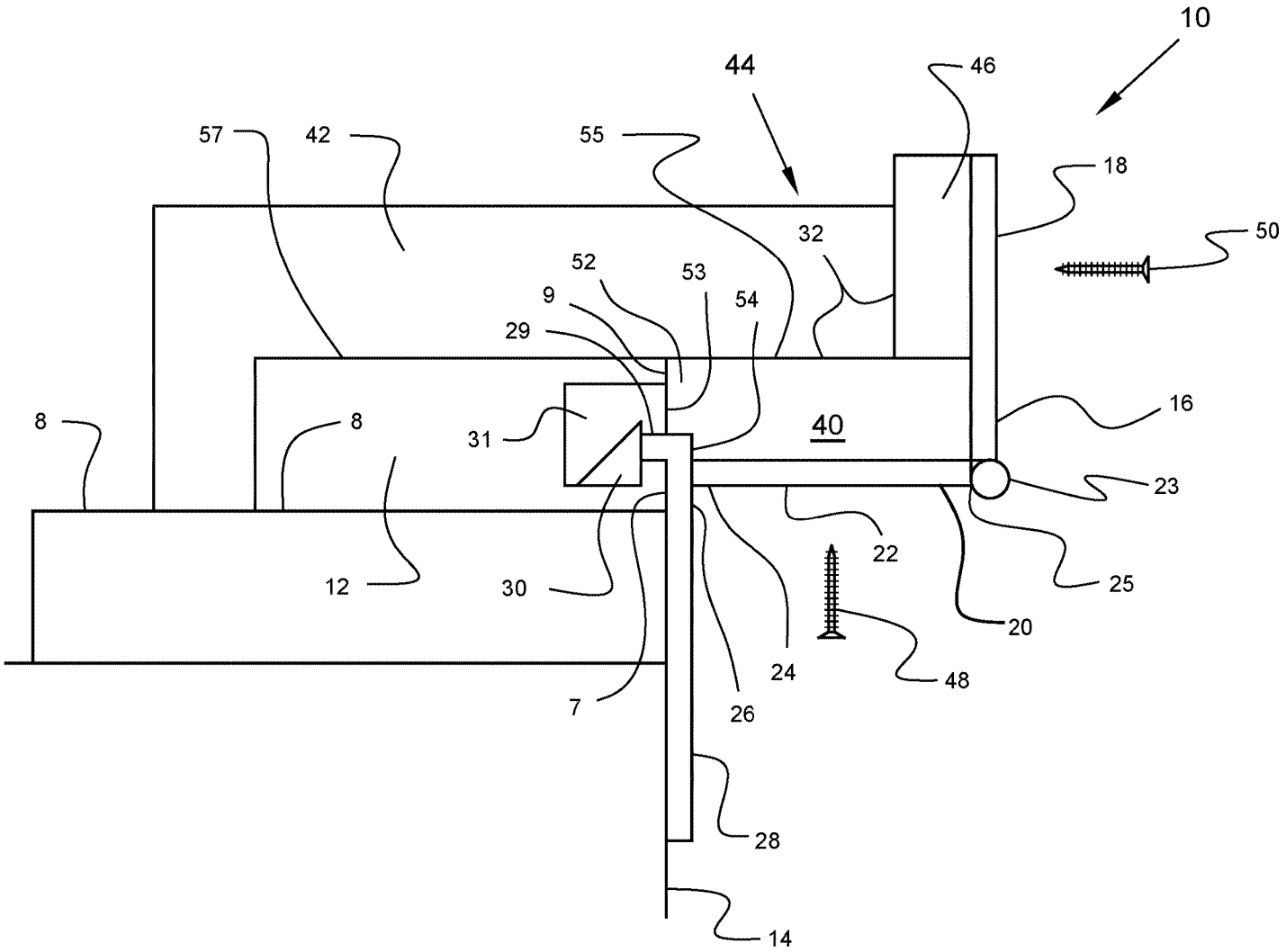
FIG. 5 is the left side elevation view of the reusable pool mold of FIG. 1, but with a securing member of the reusable pool mold detachable inserted into a recess in the pool liner receiver member and a deformable material disposed upon the liner receiver in accordance with the present invention.
Figure 6:
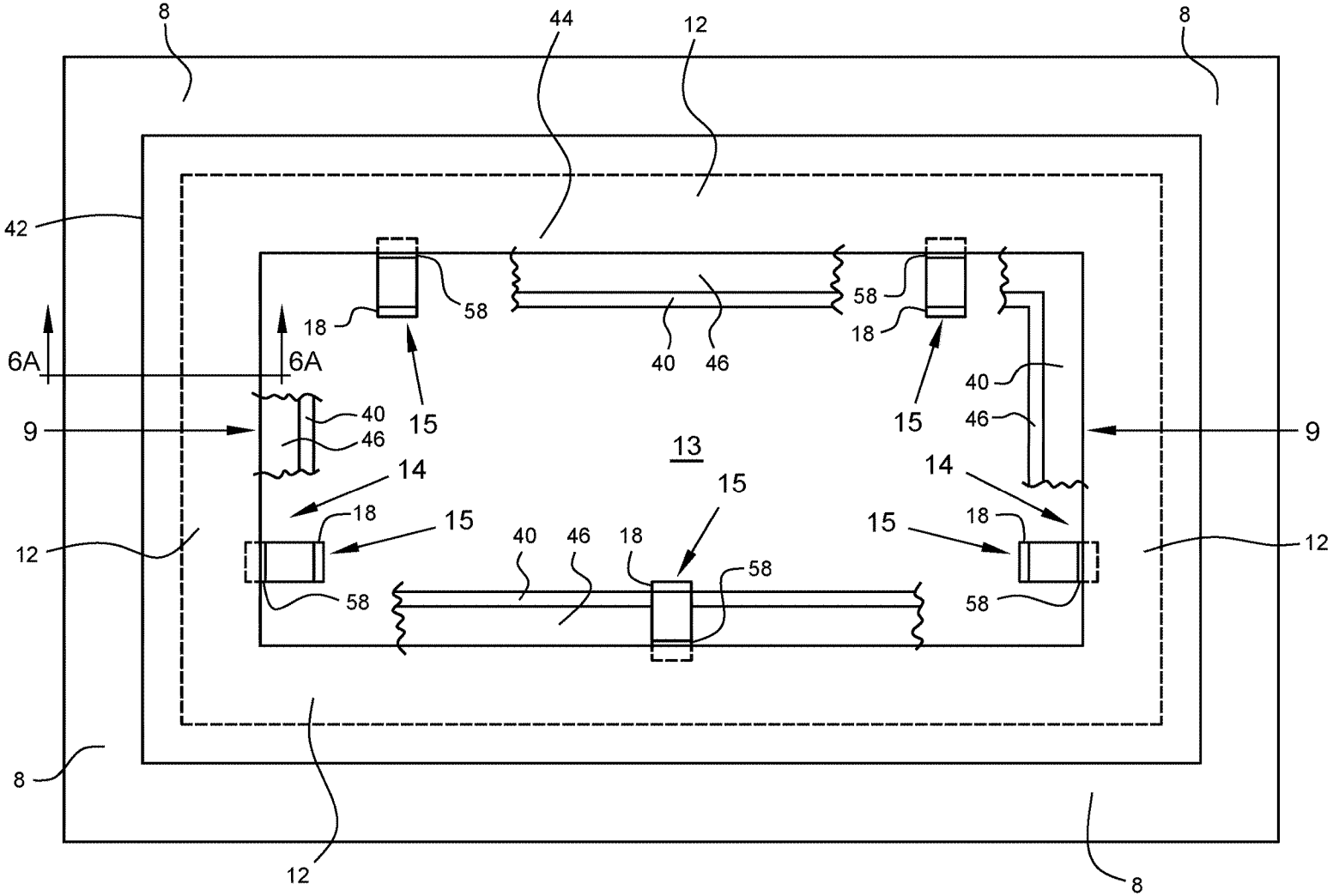
FIG. 6 is a top view of a swimming pool with a continuous pool liner receiver member disposed about the periphery of the swimming pool, and with multiple bracket members and a form member disposed above a peripheral water portion in accordance with the present invention.
Figure 6A:
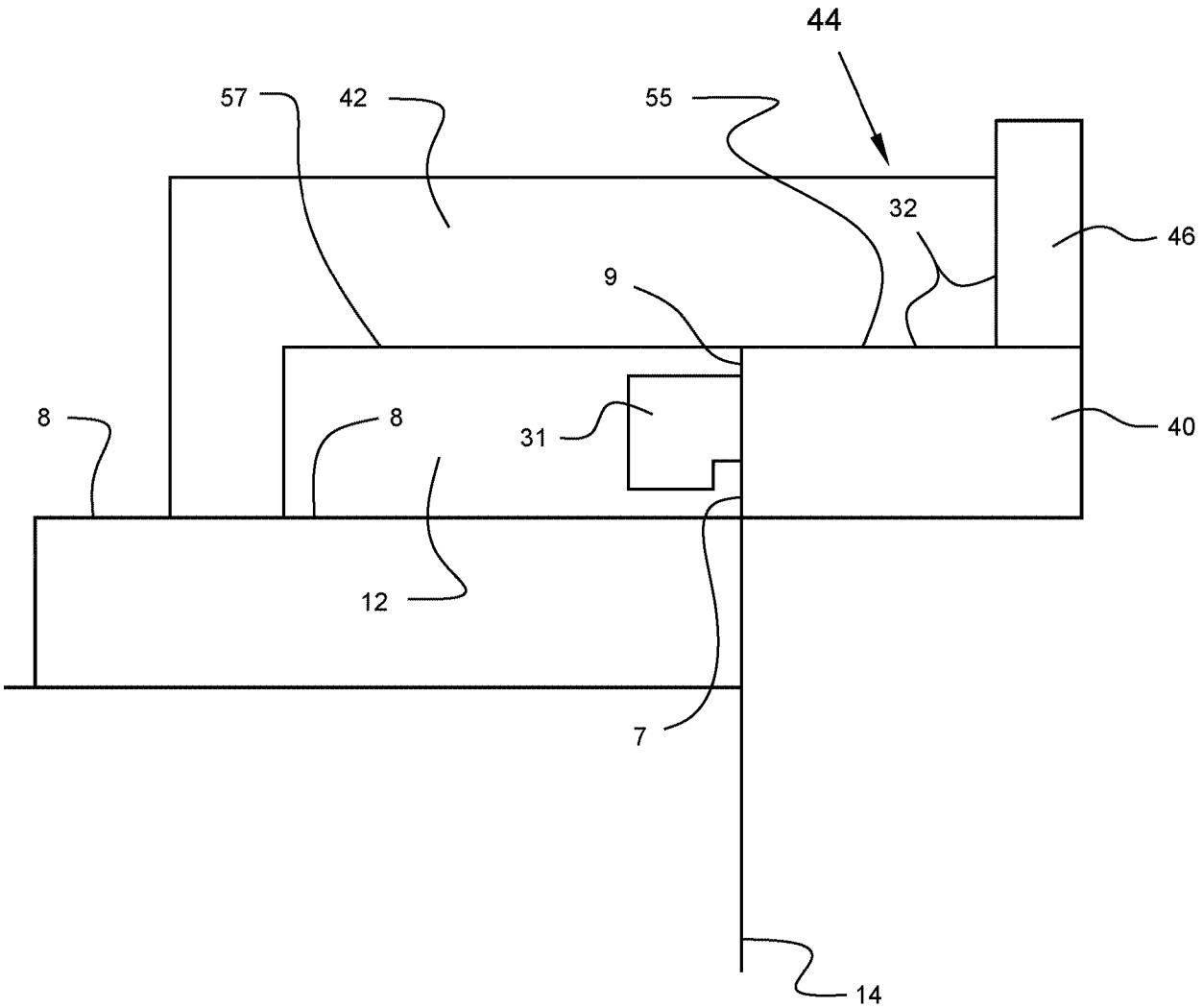
FIG. 6A is a sectional view taken along line 6A in FIG. 6.
Figure 7:
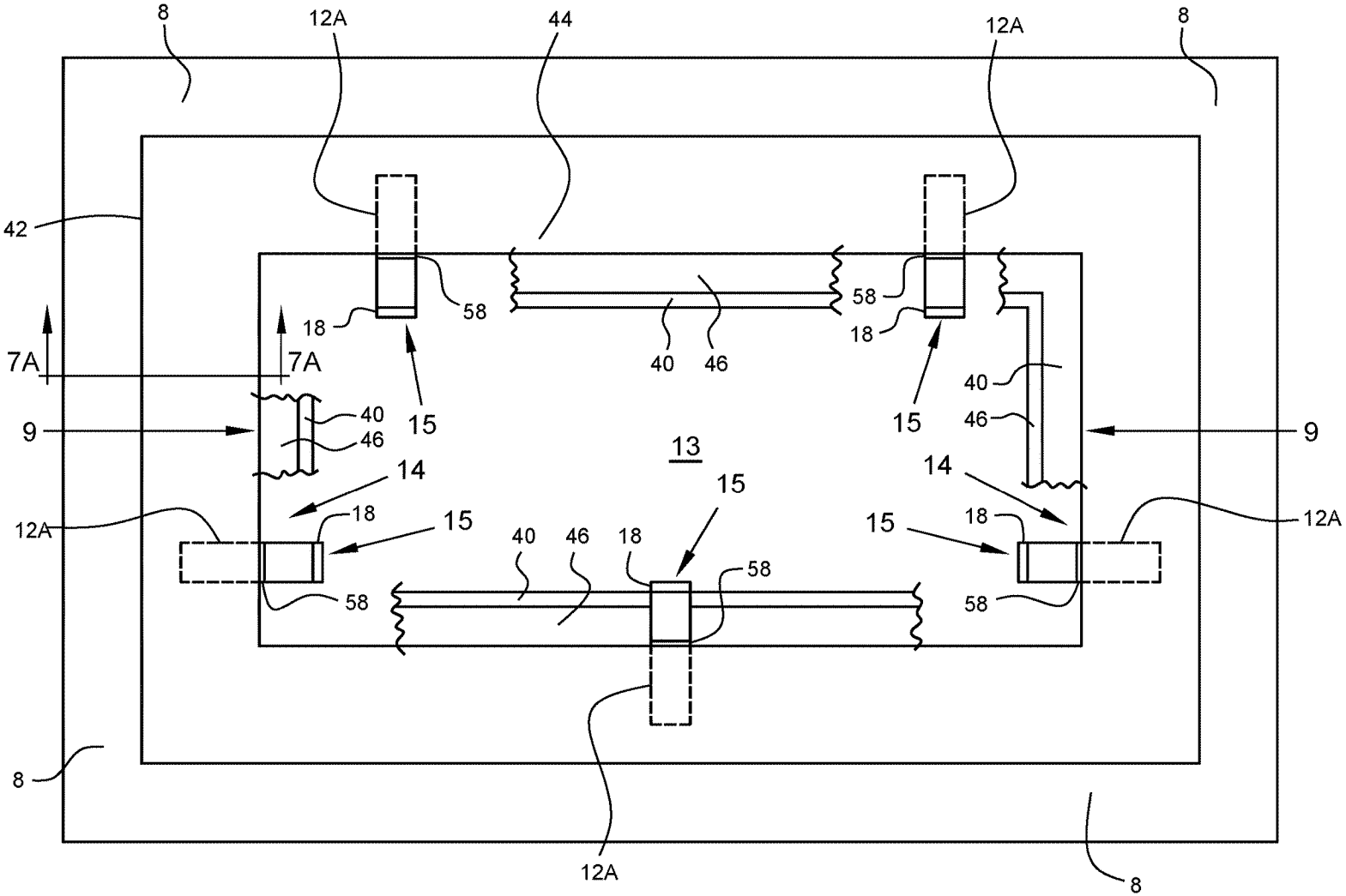
FIG. 7 is a top view of a swimming pool with multiple individual bracket retainers disposed in place of a continuous extending pool liner receiver member about the periphery of the swimming pool, and with multiple bracket members and a form member disposed above a peripheral water portion in accordance with the present invention.
Figure 7A:
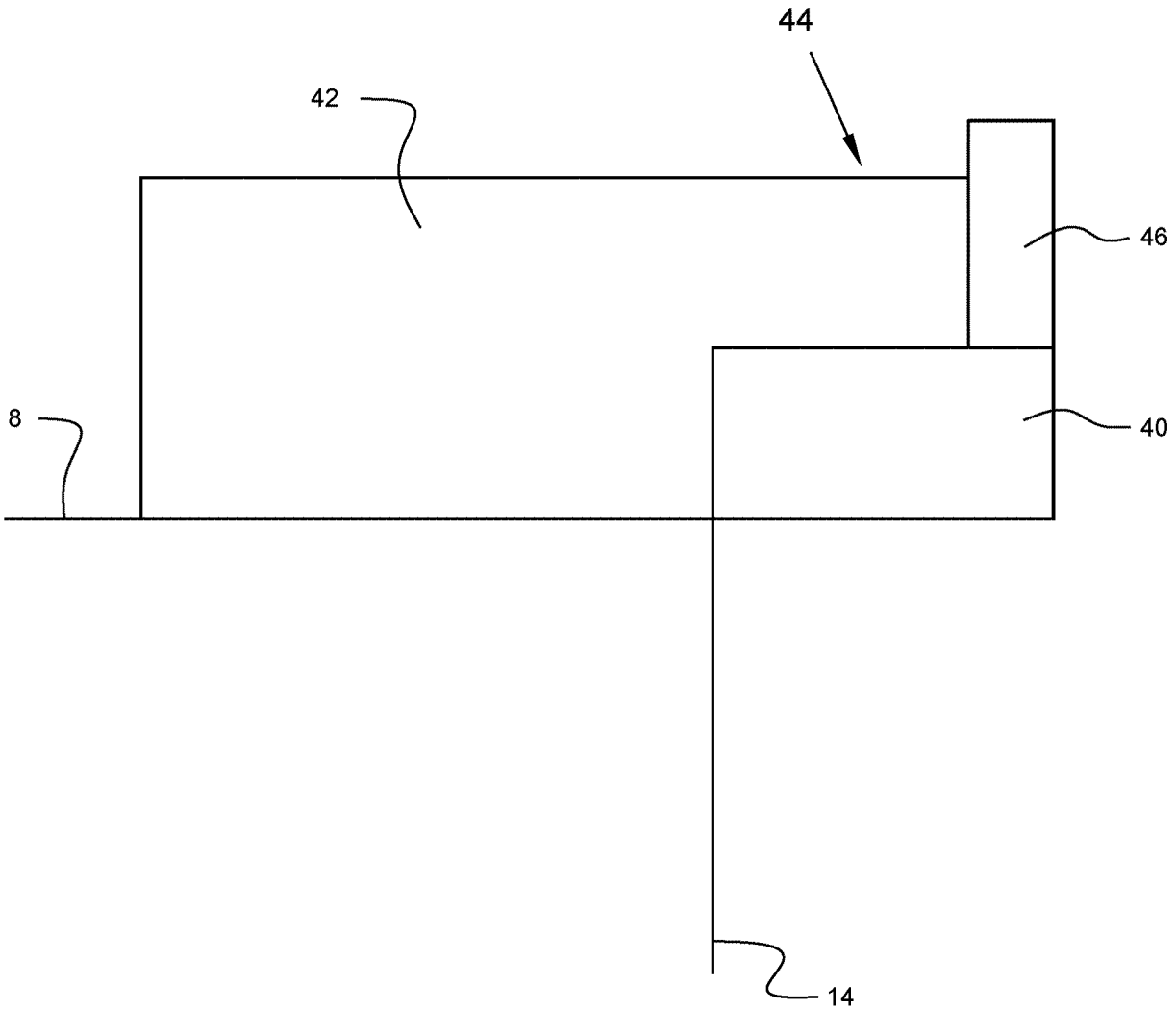
FIG. 7A is a sectional view taken along line 7A in FIG. 7.
Figure 8:
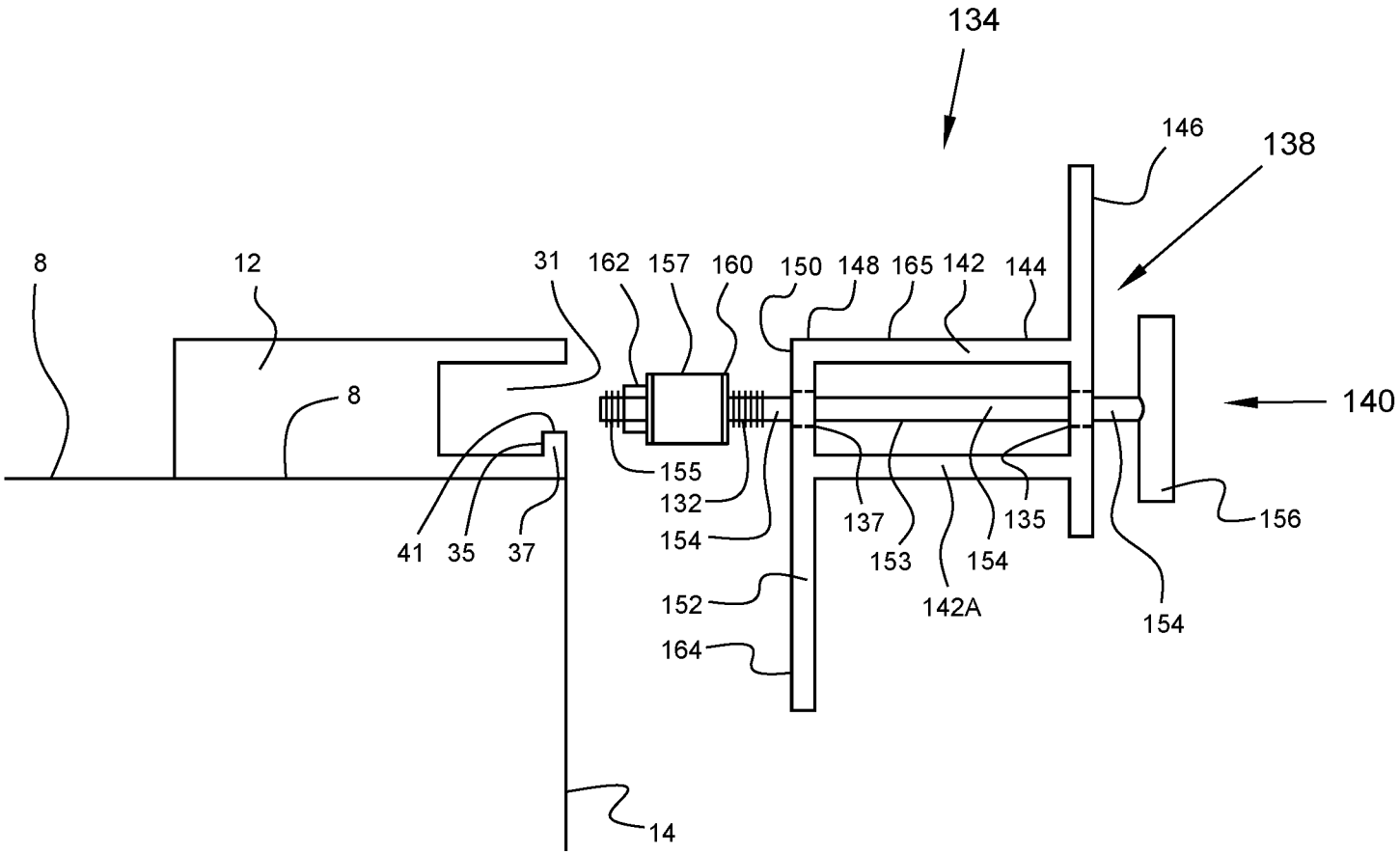
FIG. 8 is a left side elevation view of a first modified reusable pool mold for forming a swimming pool overhang above a peripheral portion of pool water, the first modified reusable pool mold is depicted adjacent to a pool liner receiver member but without a form member in accordance with the present invention.
Figure 9:
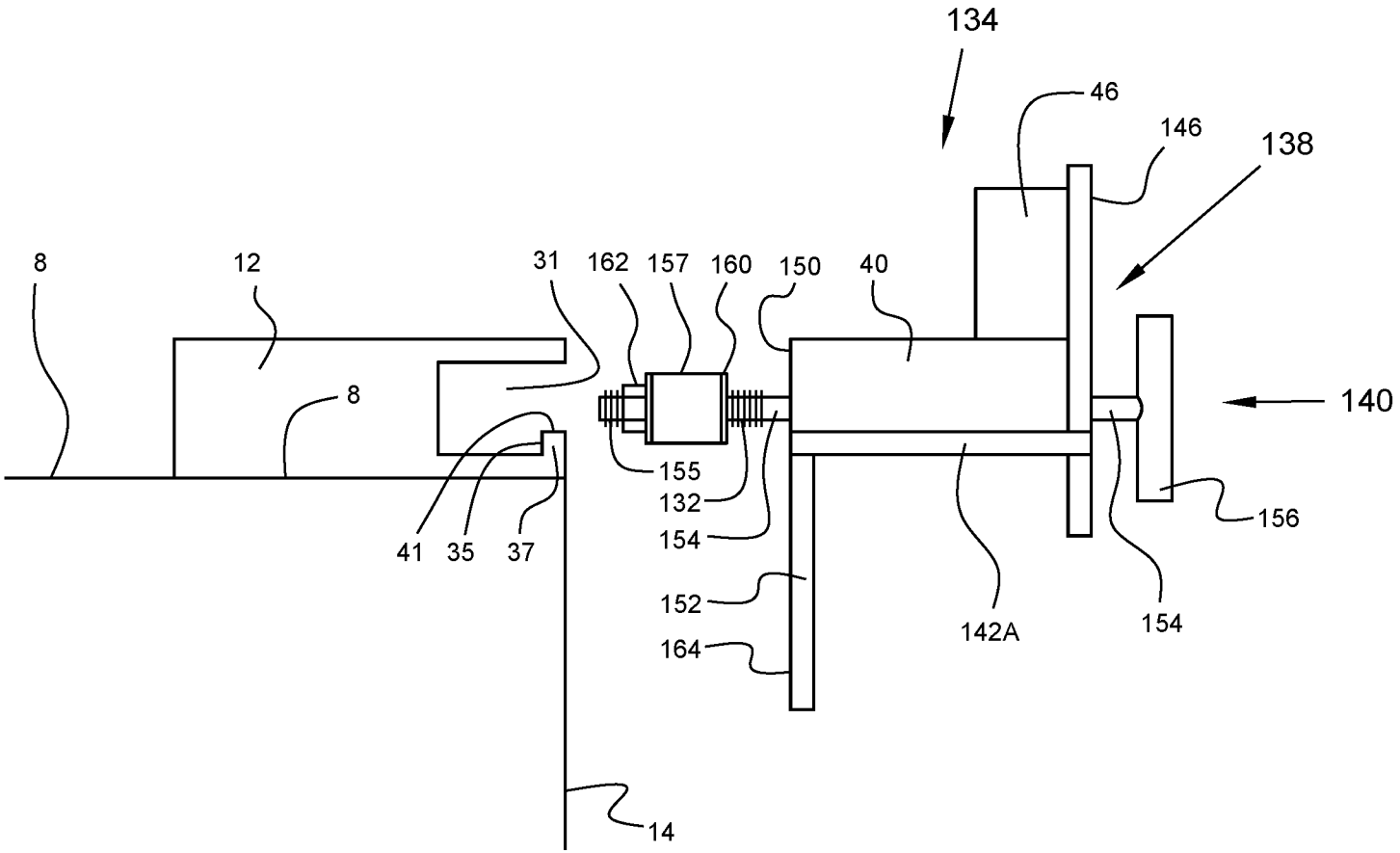
FIG. 9 is the left side elevation view of FIG. 8, but with a form member included in accordance with the present invention.
Figure 10:
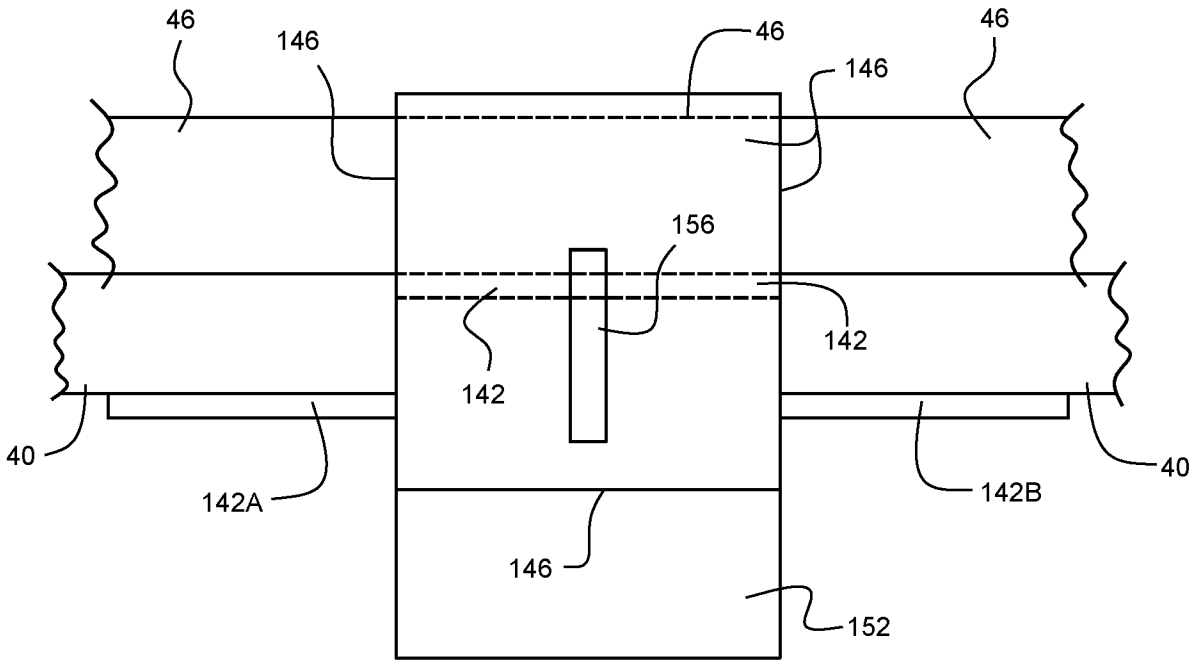
FIG. 10 is a front elevation view of FIG. 9.
Figure 11:
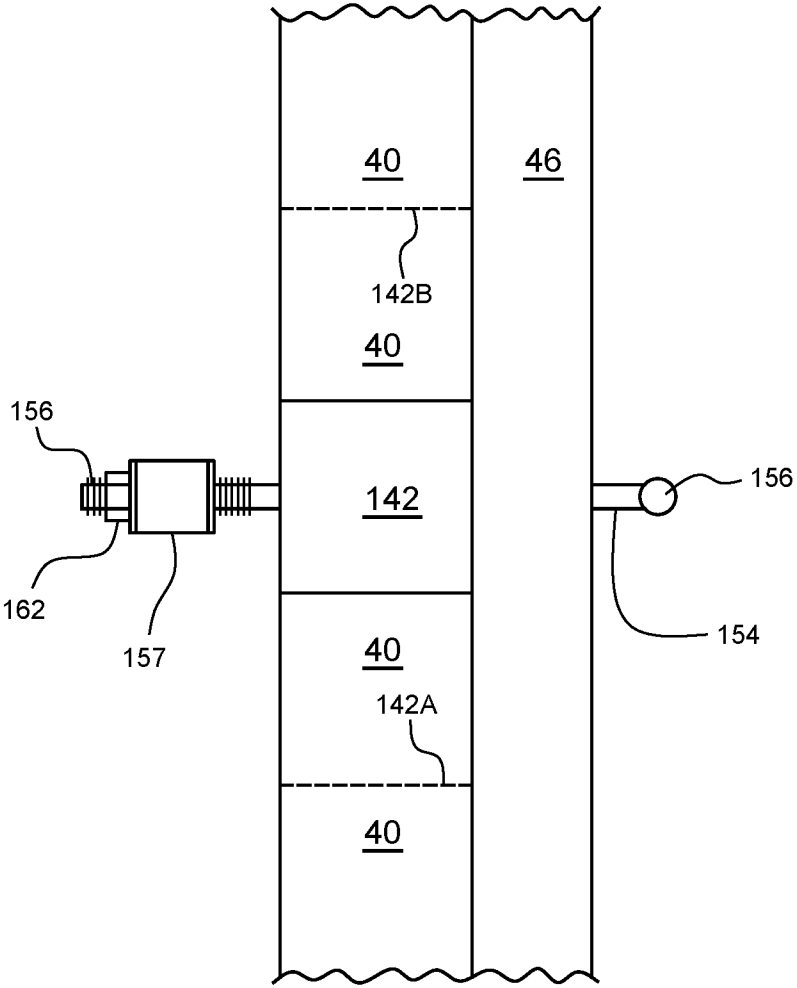
FIG. 11 is a top view of FIG. 9.
Figure 12:
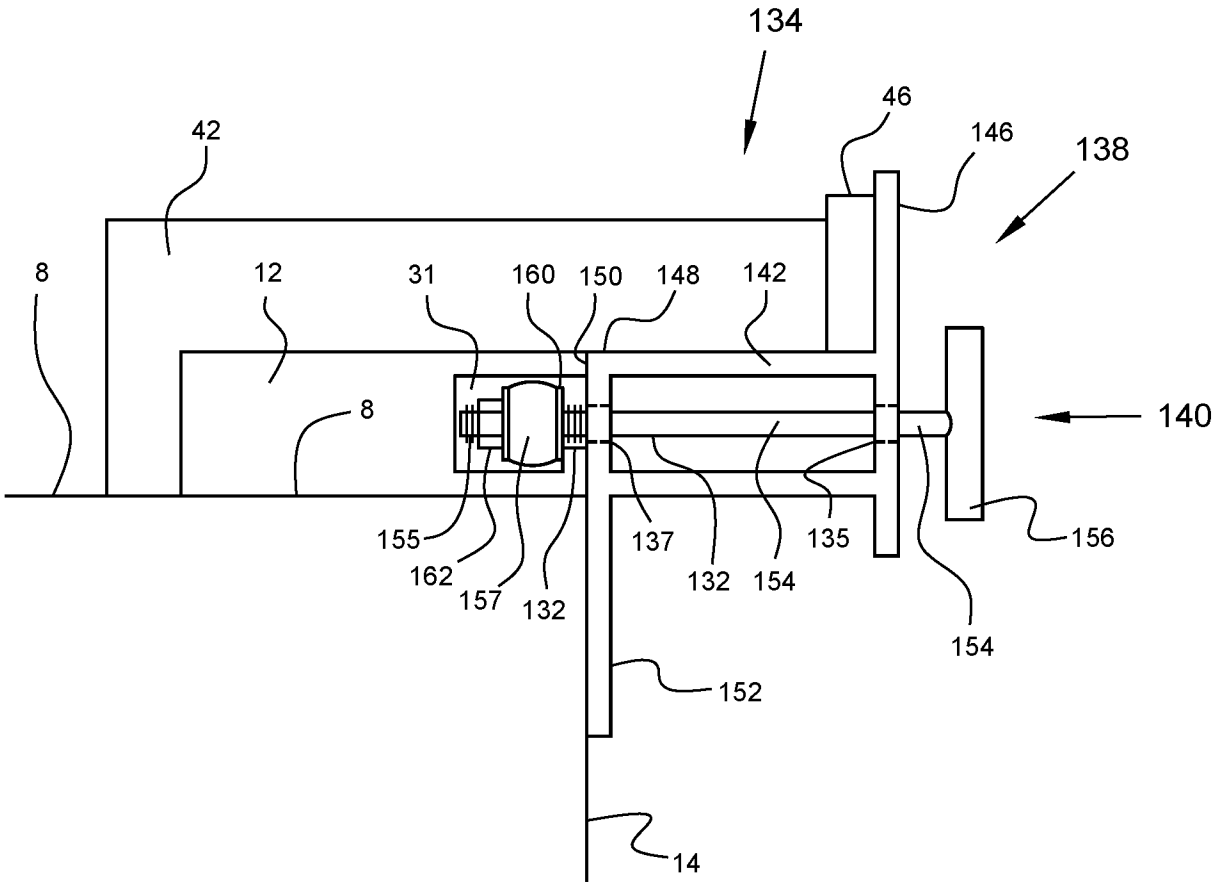
FIG. 12 is the left side elevation view of the first modified reusable pool mold of FIG. 8, but with a securing member of the first modified reusable pool mold detachably inserted into a recess in the pool liner receiver in accordance with the present invention.

The liner receiver 12 is secured to a concrete walking surface 8 whereby the liner receiver 12 encompasses a swimming pool 13. The liner receiver 12 is secured to the concrete walking surface 8 via means well known to those of ordinary skill in the art. The liner receiver 12 includes upper and lower front wall portions 7 and 9 vertically and continuously aligned with a vertical wall 14 of the swimming pool 13 (FIGS. 5 and 6). The dimensions of the reusable pool mold 10 are determined via the dimension of the overhang 44 extending above a preselected portion of pool water; and via the weight of the overhang, which can be fabricated from concrete, polymers or grout.

Figure 4:
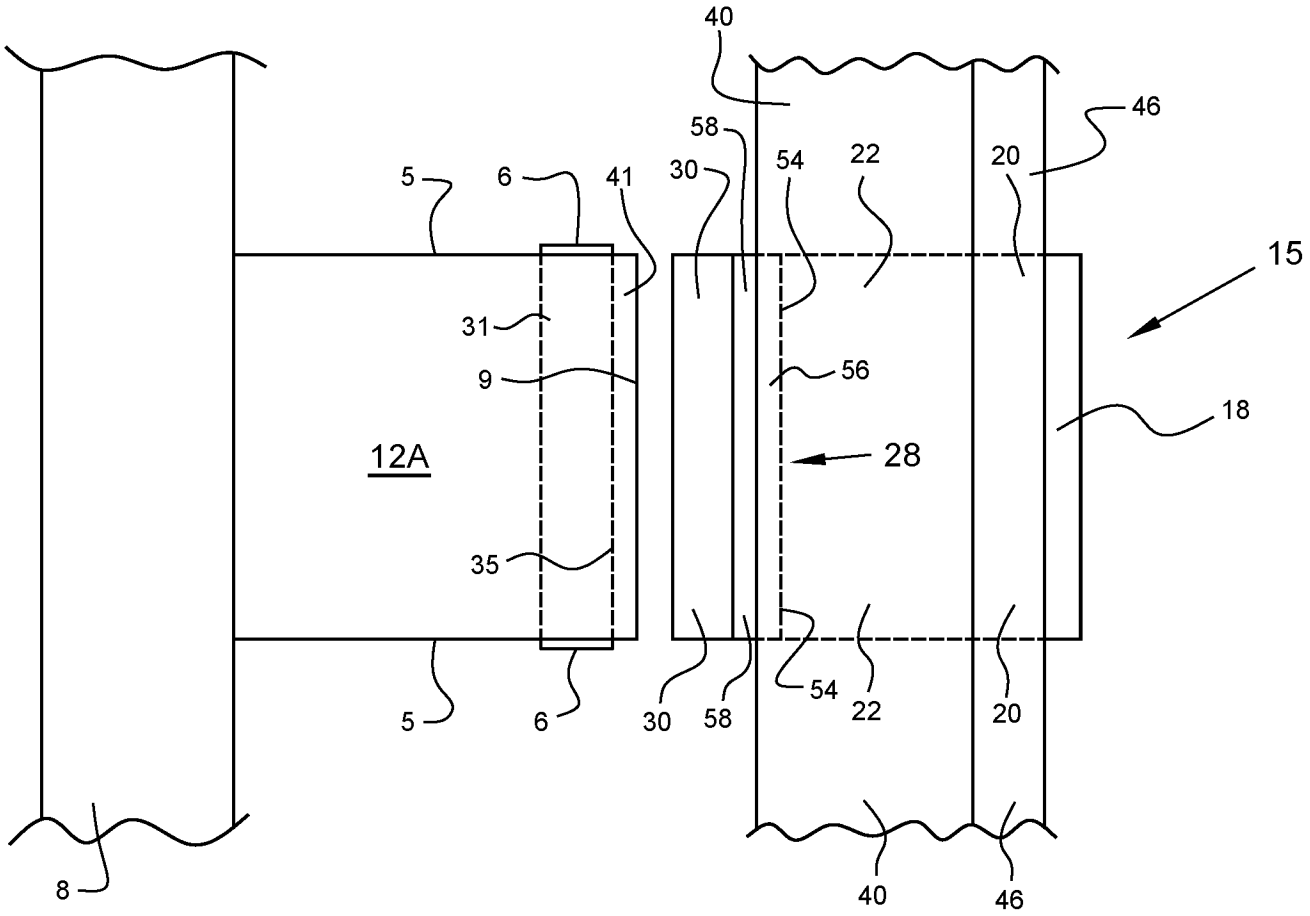
FIG. 4 is the top view of FIG. 3, but with an individual bracket retainer in place of a continuous extending liner receiver in accordance with the present invention.
Figure 5A:
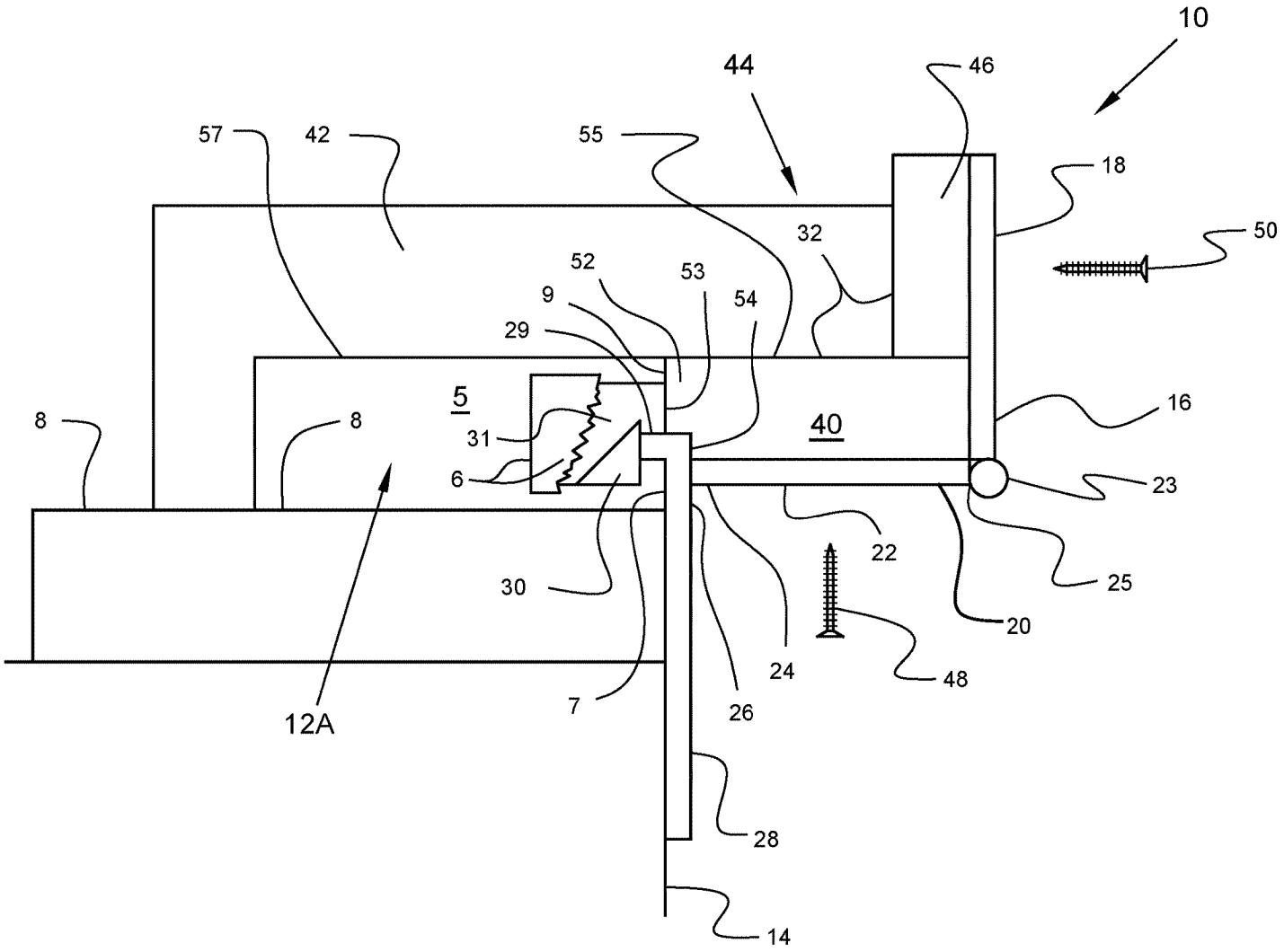
FIG. 5A is a left side elevation view of the top view of FIG. 4.

The reusable pool mold 10 includes multiple bracket members 15 (FIG. 2) detachably secured to the liner receiver 12 and disposed adjacent to the vertical wall 14 of the concrete swimming pool 13. Each individual bracket member 15 may be inserted into a continuous extending liner receiver 12 or may be inserted into a discrete cooperating bracket retainer 12A (see FIG. 4) having the same side configuration as the liner receiver 12 depicted in FIG. 1, but with a top configuration as depicted in FIG. 4. Each bracket retainer 12A is individually secured to the concrete walking surface 8 disposed about the swimming pool 13 via means known to those of ordinary skill in the art. The quantity of individually secured bracket retainers 12A is determined by the predetermined quantity of bracket members 15 required to support the selected deformable material that ultimately forms a coping or overhang above a peripheral portion of water in the swimming pool 13. Since the bracket retainers 12A do not continuously extend about the periphery of the swimming pool 13 as does the liner receiver 12, a relatively small portion of tape 6 (FIG. 5A) or similar material is required for covering the recess 31 extending to side walls 5 of the bracket retainers 12A.

The bracket members 15 are formed from an outer vertical plate member 18 having a lower portion 16 rotationally secured to an outer portion 20 of a horizontal plate member 22. The lower portion 16 can be rotationally secured to the outer portion 20 via a hinge member 23. The hinge member 23 would be added to a corner 25 of the mold 10 to pivot the outer vertical plate member 18 about one hundred and eighty degrees to a substantially vertically downward position 27 (FIG. 1). The horizontal plate member 22 includes an inner portion 24 integrally joined to an upper portion 26 of an inner vertical plate member 28. The vertical plate member 28 includes a relatively small horizontal portion 29 integrally joined to a relatively rigid securing member 30 fabricated from a relatively hard rubber. The plate members 18, 22 and 28 can be fabricated from a myriad of materials resistant to oxidation, including but not limited to stainless steel, polymers and wood.

The reusable pool mold 10 further includes securing members 30 for maintaining the position of a predetermined quantity of bracket members 15 upon a portion of the swimming pool wall 14. The securing member 30 ultimately inserts in a recess 31 in the liner receiver 12. The recess 31 is continuous in a peripheral portion of the liner receiver 12 adjacent to the pool wall 14. The recess 31 includes a configuration defined by the front wall 9 of the liner receiver 12, a jaw member and a bottom wall 43 ultimately engaged by a bottom wall 45 of the securing member 30.

The securing member 30 includes a substantially right-triangle configuration (when taking a side elevation view of the reusable pool mold 10, FIGS. 1 and 5) fabricated from a relatively hard rubber material for detachably securing the inner vertical plate member 28 to the liner receiver 12 via the recess 31 in the liner receiver 12. The triangular configuration and hard rubber fabrication material of the securing member 30 promotes the insertion of the securing members 30 inside the recess 31 in the liner receiver 12, and prevents the removal of the securing members 30 from the liner receiver 12 when the deformable material 42 is disposed upon the brackets 15. Although a triangular configuration is preferred, a myriad of configurations can be used, including but not limited to square and rectangular.

The securing member 30 is forcibly urged into the recess 31 and ultimately positioned; whereby, a lower vertical side wall portion 33 of the securing member 30 engages an inner wall portion 35 of a liner retaining jaw 37 of the liner receiver 12, and a lower portion 39 of the horizontal portion 29 of the vertical plate member 28 congruently engages a top wall 41 of the retaining jaw 37, thereby maintaining the position of the securing member 30 inside the recess 31 and maintaining engagement of the vertical plate member 28 against the vertical wall 14 of the swimming pool 13 and against the liner retaining jaw 37, irrespective of deformable material being disposed upon the reusable pool mold 10.

The pool mold 10 further includes a form member 32 detachably secured to the vertical and horizontal plate members 18 and 22. The form member 32 includes a first form member 40 that is generally a horizontal 2×4 wood (or similar sized, non-deformable material) form that supports a bottom portion of a deformable material (concrete) 42 overhang 44. The horizontal wood form 40 engages the liner receiver 12 whereby the deformable material 42 is prevented from entering the recess 31, thereby enabling the manual removal of the securing member 30 from the recess 31.

The form member 32 further includes a second form member 46 that is generally a 2×4 wood form 46 vertically disposed upon and cooperating with the horizontal form 40 to continuously extend above a peripheral water portion of the pool 13. The horizontal wood form 40 is detachably secured to the horizontal plate member 22 via wood screws or similar fasteners 48, and the vertical wood form 46 is secured to the outer vertical plate member 18 via fasteners 50. The form member 32 receives a deformable material 42 that ultimately solidifies; whereby, the form member 32 configures a continuously extending overhang 44 above the peripheral portion of water surface inside the pool 13.

Although the form members 40 and 46 are described as wood 2×4's, the form members 40 and 46 can be dimensioned however the user may require to achieve a predetermined coping or overhang configuration; and fabricated from a myriad of materials, including but not limited to polymers, aluminum, stainless steel, galvanized steel and powder coat steel. Further, the brackets 15 may be fabricated from the materials as the form members 40 and 46, and can be dimensioned to support the form members 40 and 46 combined with the predetermined quantity and type of deformable material used to form the coping or overhang.

The first form member 40 includes a protrusion portion 52 formed via a removed inner lower section of the first form member 40, resulting in first and second vertical inner side walls 53 and 54, and a horizontal bottom wall 56 perpendicularly engaging both first and second inner side wall 53 and 54. The first vertical inner side wall 53 is dimensioned to congruently engage the upper front wall portion 9 of the liner receiver. The first vertical inner side wall 53 is also dimensioned to perpendicularly engage a top wall of the horizontal portion 29 of the vertical plate member 28, whereby deformable material 42 is prevented from "leaking" into the recess 31. The second vertical inner side wall 54 is dimensioned to engage a top vertical wall of the upper portion 26 of the inner vertical plate member 28, whereby, the horizontal bottom wall 56 of the protrusion portion 52 engages an outer portion of the top wall 58 of the horizontal portion 29 of the vertical plate member 28.

The first and second vertical inner side walls 53 and 54, and the horizontal bottom wall 56 cooperate to dispose the form member 40, whereby, the form member 40 engages the upper front wall portion 9 of the liner receiver 12 and inner vertical plate member 28; when the securing member 30 is inserted into the liner receiver recess 31 and the securing member 30 is lowered inside the recess 31 until the lower portion 39 of the of the horizontal portion 29 of the vertical plate member 28 engages a top wall 41 of the jaw member 37, and the bottom wall 45 of the securing member 30 engages a bottom wall 43 of the recess 31, resulting in the capture of the jaw member 37 between a lower vertical wall 33 of the securing member 30 and the vertical plate member 28. The captured jaw member 37 maintains the securing member 30 inside the recess 31, and secures the position of the first form member 40 relative to the liner receiver 12 and the inner vertical plate member 28, and maintains the position of the bracket member 15 relative to the swimming pool wall 14 when deformable material 42 is disposed upon the mold 10 to form the overhang 44 over the selected peripheral portion of water in the pool 13; whereby, a bottom wall 55 of the overhang 44 is lineally aligned with a top wall 57 of the liner receiver 12.

In the event that the bottom wall 55 of the overhang 44 is to be disposed below the top wall 57 of the liner receiver 12, the horizontal plate member 22 can be integrally joined to the inner vertical plate member 28; whereby, the top wall of the first horizontal form 40 is below the top wall 57 of the liner receiver 12 (but not so far below the top 57 of the liner receiver 12, whereby the securing member 30 is not extractable from the recess 31 after the deformable material 42 solidifies), resulting in the bottom wall 55 of the overhang 44 being lowered a predetermined distance. In the event that lowered top wall of the first horizontal form 40 exposes the recess 31 to deformable material 42, tape, polystyrene or similar flexible material (not depicted) is required to "plug" the recess 31 until the deformable material solidifies and the securing member 30 forcibly removed from the recess 31.

In the event an end portion of a pool liner (not depicted) is present in the liner receiver 12; whereby, a lower portion 39 of the horizontal portion 29 is not disposed upon a top wall 41 of the jaw member 37, and/or the bottom wall 45 of the securing member 30 is not disposed upon the bottom wall 43 of the recess 31, the relatively rigid but deformable securing member 30 will remain removably attached to the liner receiver 12; the inner vertical plate member 28 will congruently engage the vertical wall 14 of the swimming pool 13, and the position of the bracket 15 relative to the liner receiver 12 and the vertical swimming pool wall 14 will remain constant when deformable material 42 is disposed upon first and second form members 40 and 46 supported by the brackets 15.

The pool mold 10 is ultimately removed from the solidified deformable material 42 and liner retainer 12 by first removing the fasteners 48 and 50 from the horizontal and vertical wood forms 40 and 46. The outer vertical plate member 18 is then rotated substantially one hundred and eighty degrees, whereby, the vertical wood form 46 can be separated from the solidified deformable material 42 and the horizontal form 40, followed by the horizontal form 40 being slidable removed from between the solidified deformable material 42 and the horizontal plate member 22. The securing member 30 can then be elevated inside the liner receiver recess 31 until the securing member 30 can be horizontally removed from the recess 31, resulting in the entire reusable pool mold 10 being separated from the deformable material 42 and the liner receiver 12, then reused at another swimming pool.

In operation, a predetermined quantity of reusable molds 10 are dimensioned to secure first and second substantially horizontal and vertical form members 40 and 46 above a peripheral portion of water in a swimming pool 13. The quantity and dimensions of the reusable brackets 15 are determined by the peripheral dimensions of the swimming pool 13, the horizontal and vertical dimensions of the overhang 44 above pool water, and the weight of the material ultimately disposed upon the form member 32. The preferred distance separating adjacent reusable brackets 15 is about three feet for a linear portion of a swimming pool wall 14, and about two feet for a curved or arcuate portion of a swimming pool wall 14. The dimensions of the reusable form member 32 are determined by the peripheral dimensions of the swimming pool 13, the horizontal and vertical dimensions of the coping or overhang 44 above pool water, and the weight of the material ultimately disposed upon the form member 32. As the dimensions of the overhang 44 increase and/or the weight of the overhang material increase, the quantity and dimensions of the brackets 15 increase; and the dimensions of the form member 32 increase. The quantity and dimensions of the brackets 15, and the dimensions of form member 32 required for a selected swimming pool 13 overhang 44 are well known to those of ordinary skill in the art.

Referring now to FIGS. 8-12, a first modification to the reusable pool mold 10 in accordance with the present invention for forming swimming pool overhangs 44 is depicted and is denoted as numeral 134. The first modified reusable pool mold 134 is detachably secured to a liner receiver 12 disposed upon a top surface 8 of a swimming pool 13 (see FIG. 6). The modified mold 134 includes a base member 138 detachably secured to a handle member 140. The base member 138 includes a horizontal member 142 having an outer end 144 integrally joined to a mid-portion of an outer vertical member 146. The horizontal member 142 has an inner end 148 integrally joined to a top end 150 of an inner vertical member 152. The outer vertical member 146 includes a non-threaded aperture 135 axially aligned with a threaded orifice 137 in the inner vertical member 152. The handle member 140 includes a hand grip 156 integrally joined to a cylindrical bolt member 154 having a threaded end portion 155.

The horizontal member 142 of the base member 138 includes first and second horizontal member extensions 142A and 142B for supporting horizontal first form member 40 sections; whereby, a top wall 165 of the horizontal member 142 is co-planar with top walls 166 and 167 of respective horizontal first member 40 sections. A bottom wall 168 of a vertical second form member 46 continuously extends upon a coplanar surface formed from the top walls 165, 166 and 167.

The vertical second form member 46 continuously extends about and above a peripheral portion of a swimming pool 13; whereby, the vertical second form member 46 is constantly engaged with the base member 138 or horizontal first form member to ultimately form a predetermined coping or overhang above a predetermined portion of water in a swimming pool 13.

The non-threaded aperture in the outer vertical member 146 is dimensioned to slidably receive the threaded end portion 155 and cylindrical portion 153 of the bolt member 154. The threaded orifice 137 in the inner vertical member 152 is dimensioned to rotationally receive the threaded inner end portion 155 and slidably receive the cylindrical portion 153 of the bolt member 154 after the threaded inner end portion 155 has been rotated through the threaded orifice; whereupon, a retaining washer 160 is slid over the threaded inner end portion 155 followed by a locking member 157 (fabricated from a relatively rigid hard rubber material) and a nut 162 that is rotationally secured to the threaded inner end portion 155 of the bolt member 154, thereby slidably maintaining the washer 160 and locking member 157 between an inner wall 164 of the inner vertical member 152 and the nut 162. The configuration of the locking member 157 cooperates with the configuration of the recess 31, whereby, the locking member 157 is snugly seated in the recess 31 during operation of the modified reusable pool liner mold to stabilize the mold 134 and prevent movement of the mold 134 when a deformable material 42 (FIGS. 3 and 4) is disposed upon the mold 134.

In operation, multiple first modified reusable pool molds 134 are disposed proximate to cooperating recesses 31 in corresponding pool liner receivers 12, whereby, for each mold 134, the nut 162, locking member 157 and retaining washer 160 are sequentially inserted into the recess 31 when the inner wall 164 of the inner vertical member 152 engages the pool wall 103. To secure the position of the first modified mold 134 upon the pool wall 14 when forming a swimming pool surface 44 (FIG. 6) that overhangs the water in the pool 13, the user engages the inner wall 164 of the inner vertical member 152 with the pool wall 14, then rotates the hand grip 156 to horizontally move the locking member 157 in an extraction direction from the recess 31 by rotationally engaging a threaded inner portion 132 of the bolt member 154 with the threads of the orifice 137 in the inner vertical member 152. The locking member 157 moves horizontally in the recess 31 until the retaining washer 160 engages an inner wall 35 of the liner securing jaw 37; whereupon, the continued rotation of the hand grip 156 "squeezes" or compresses the locking member 157 horizontally between the retaining washer 160 and nut 162, resulting in the locking member 157 expanding radially until "plugging" the recess 31 and stabilizing the position of the first modified mold 134 inside the liner receiver 12 and upon pool wall 14. The first modified pool mold 134 is dimensioned to cooperate with multiple molds 134 supporting wooden rail members 40 and 46 to peripherally extend a completed form about a pool wall 13 to receive a deformable material 42 that ultimately solidifies to form a pool overhang 44 above the water in the pool 13.

Figure 13:
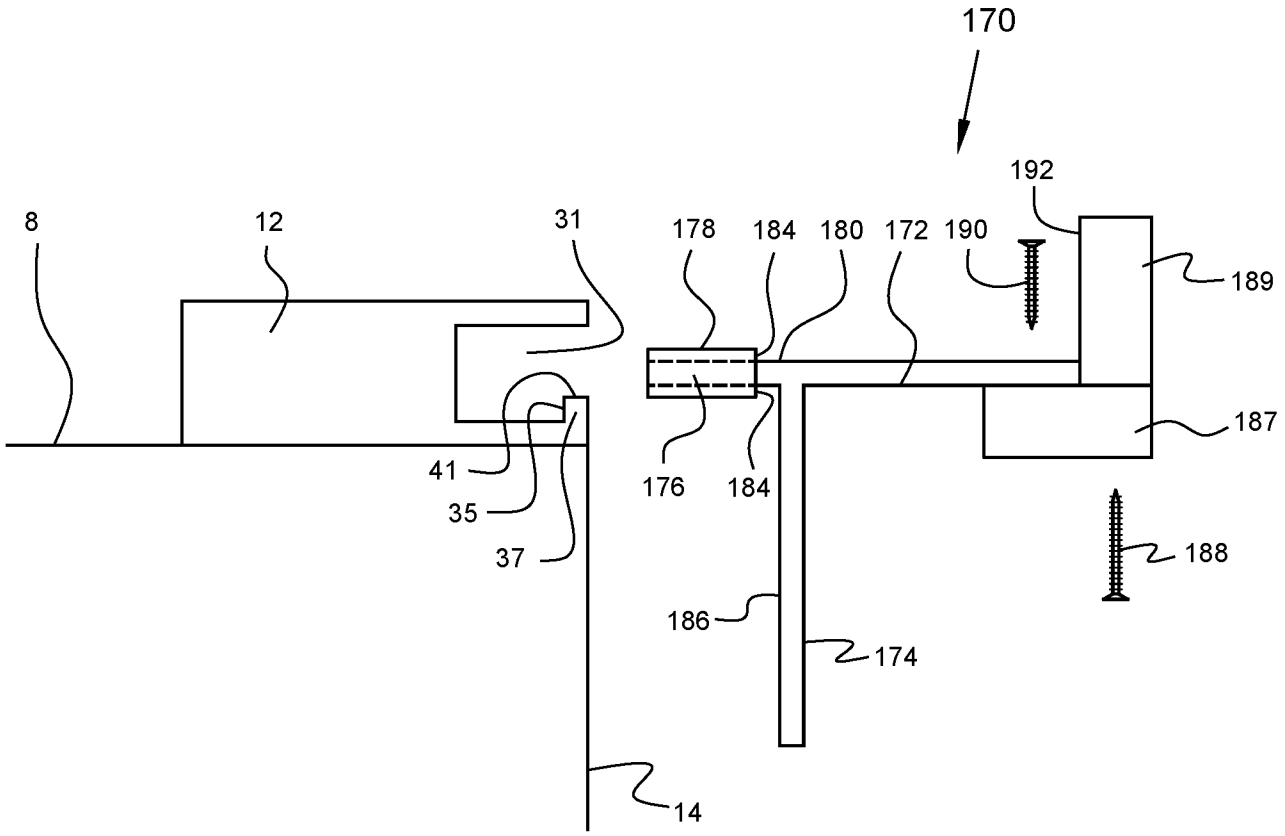
FIG. 13 is a left side elevation view of a second modified reusable pool mold for forming a swimming pool overhang above a peripheral portion of pool water, the second modified reusable pool mold is depicted adjacent to a pool liner receiver member in accordance with the present invention.
Figure 14:
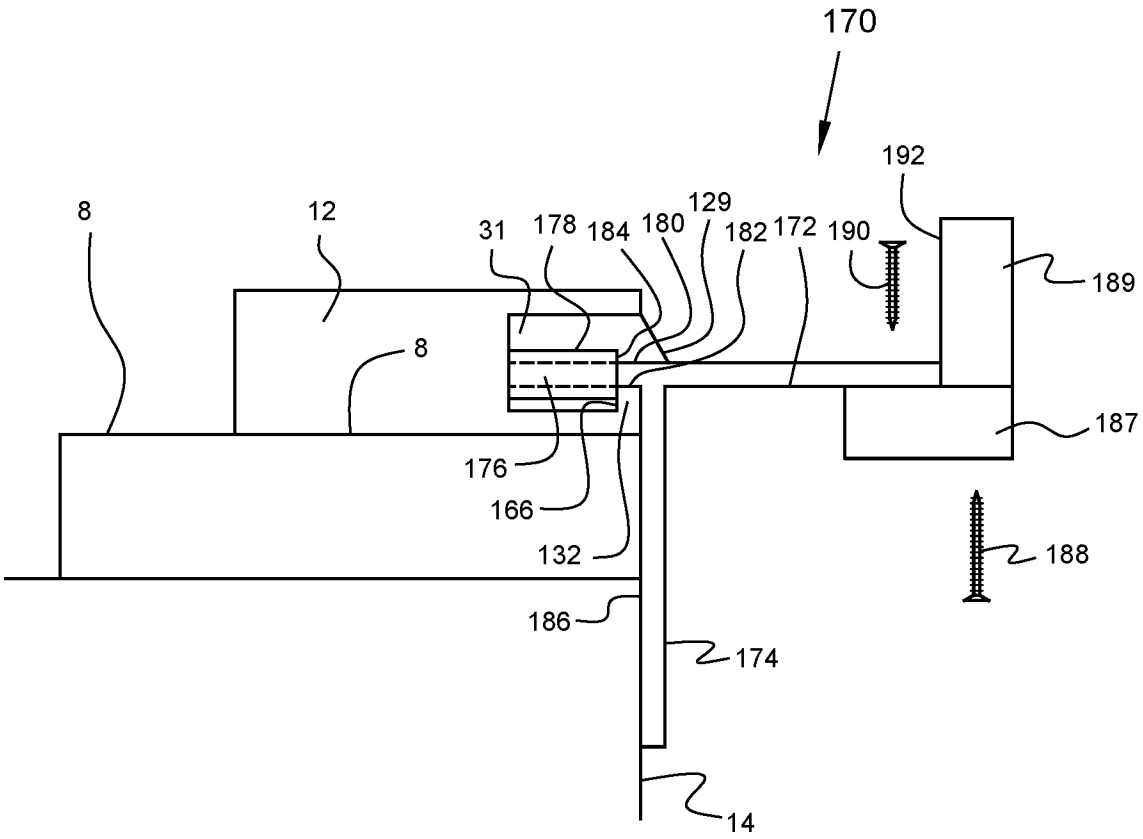
FIG. 14 is the left side elevation view of the second modified reusable pool mold of FIG. 13, but with a securing member of the second modified reusable pool mold detachably inserted into a recess in the pool liner receiver member in accordance with the present invention.

Referring now to FIGS. 13 and 14, a second modification to the reusable pool mold 10 in accordance with the present invention for forming swimming pool overhangs 44 is depicted and is denoted as numeral 170. The second modification 170 includes a horizontal member 172 integrally joined to a vertical member 174 whereby a modified "T" configuration is formed with an inner end portion 176 of the horizontal member 172 extending a sufficient distance to forcibly and permanently receive a locking member 178 having a coating material (well known to those of ordinary skill in the art) disposed upon an outer surface of the locking member 178 to promote insertion of the locking member 178 into a recess 31 of a swimming pool liner retainer 12. The inner end portion 176 is relatively longer than the axial length of the locking member 178, thereby exposing a relatively small portion 180 of the horizontal member 172 that ultimately engages a top wall 41 of a liner retainer jaw 37.

An outer wall 184 of the locking member 178 ultimately engages an inner wall 35 of the retainer jaw 37 after the exposed portion 180 of the horizontal member 172 is forcibly disposed upon the top wall 41 of the retainer jaw 37, resulting in the locking member 178 being slightly compressed, thereby locking the position of the third modified mold 170 in the recess 31 and disposing an inner wall 186 of the vertical member 174 upon a swimming pool wall 14. The mold 170 further includes a horizontal wood 2×4 form 187 secured to the horizontal member 172 via securing screw 188, and a vertical wood 2×4 form 189 secured to the horizontal wood form 187 via securing screw 190. The horizontal and vertical forms 187 and 189 can be fabricated from wood, polymers and lightweight metals such as aluminum.

In operation, multiple second modified molds 170 are manually inserted into respective recesses 31 of liner retainers 12, whereby, for each mold 170, the locking member 178 is axially compressed a distance that enables the exposed portion 180 of the horizontal member 172 to engage the top wall 41 of the retainer jaw 37, thereby securing the position of the locking member 178 inside the recess 31 and disposing the inner wall 186 of the vertical member 174 upon the pool wall 14. To prevent deformable material from entering the recess 31, duct tape 129 is used to seal the recess 31 after the locking member 178 is disposed and secured inside the recess 31. The mold 170 is stabilized upon the pool wall 14 by the slightly deformable locking member 178 being compressed inside the recess 31; the exposed portion 180 of the horizontal member 172 engaging the top wall 41 of the retainer jaw 37; and the vertical member 174 engaging the pool wall 14, thereby allowing a deformable material 42 to be disposed upon the mold 170. After the deformable material 42 solidifies to form an overhang 44 above a peripheral portion of water in the pool 13, the securing screws 188 and 190 are removed from the wood forms 187 and 189 disposed about the periphery of the pool 13; the wood forms 187 and 189 are separated from the solidified deformable material 42; and the locking members 178 removed from the recesses 31 in the liner retainers 12.

Figure 15:
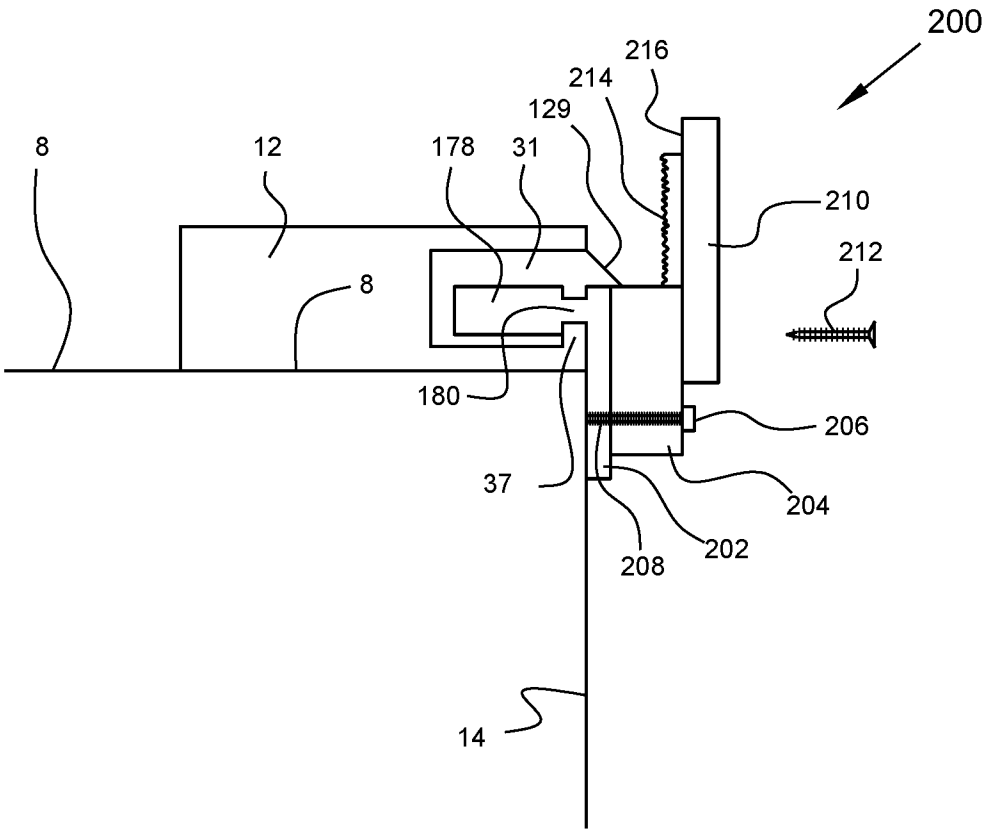
FIG. 15 is a left side elevation view of a third modified reusable pool mold for forming a swimming pool overhang above a peripheral portion of pool water, the third modified reusable pool mold is depicted with a securing member detachably inserted into a recess in a pool liner receiver member in accordance with the present invention.

Referring now to FIG. 15, a third modification to the reusable pool mold 10 is depicted for forming swimming pool overhangs in accordance with the present invention and is denoted as numeral 200. The third modified mold 200 includes the locking member 178 and exposed horizontal portion 180 depicted in FIGS. 7 and 8 and specified above, but with the exposed portion 180 integrally joined to a vertical sheet or plate member 202. The third modified mold 200 further includes an inner vertical form 204 (fabricated from wood, polymer or steel) secured to the vertical member 202 via a threaded bolt 206 rotationally inserted into a threaded orifice 208 in the vertical plate member 202. An outer vertical form 210 fabricated from the same material as the inner form 204 is secured to the inner form 204 via a securing screw 212 that penetrates the outer form 210 and the inner form 204 a distance that provides stability to the outer form 210 relative to the vertical member 202. The outer form 210 has a longitudinal dimension relatively longer than the inner form 204, and a lateral dimension relatively shorter than the inner form 204. A liner 214 is secured to an inner wall 216 of the outer form 210. The liner 214 impresses a predetermined design into a vertical edge portion of deformable material (not depicted) that engages the liner 214, and after the deformable material solidifies and the molds 200 are removed, a pool overhand 44 (FIG. 4) is revealed having a design viewable by persons inside and around the pool.

The operation of the third modified bracket 200 is similar to the operation of the second modified bracket 170 as to the forcible compression of the locking member 178 and the engagement of the exposed portion 180 upon the retainer jaw 37. The functional difference between the modified brackets 170 and 200 is that a plurality of second modified brackets 170 form a pool overhang that extends over water a greater distance perpendicular to the pool wall 14 than a perpendicular distance corresponding to a pool overhang formed from a plurality of third modified brackets 200. The liner 214 for the third modified bracket 200 can be included with the second modified bracket 170 by securing the liner 214 to an inner wall 192 (see FIGS. 7 and 8) of the outer vertical form 189.

Figure 16:
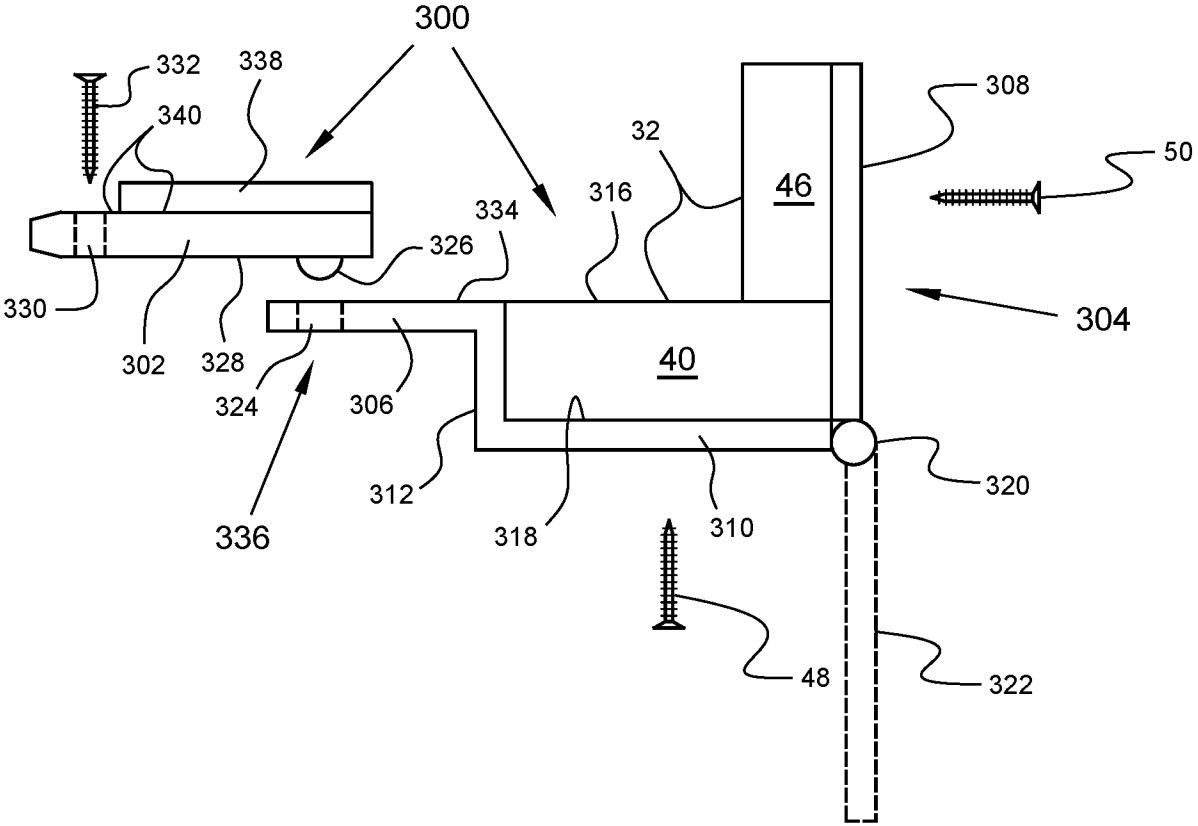
FIG. 16 is a left side elevation view of a fourth modified reusable pool mold for forming a swimming pool overhang above a peripheral portion of pool water, the fourth modified reusable pool mold is depicted with a locking tab disposed above a bracket member, and a form member detachably secured to the bracket member in accordance with the present invention.
Figure 17:
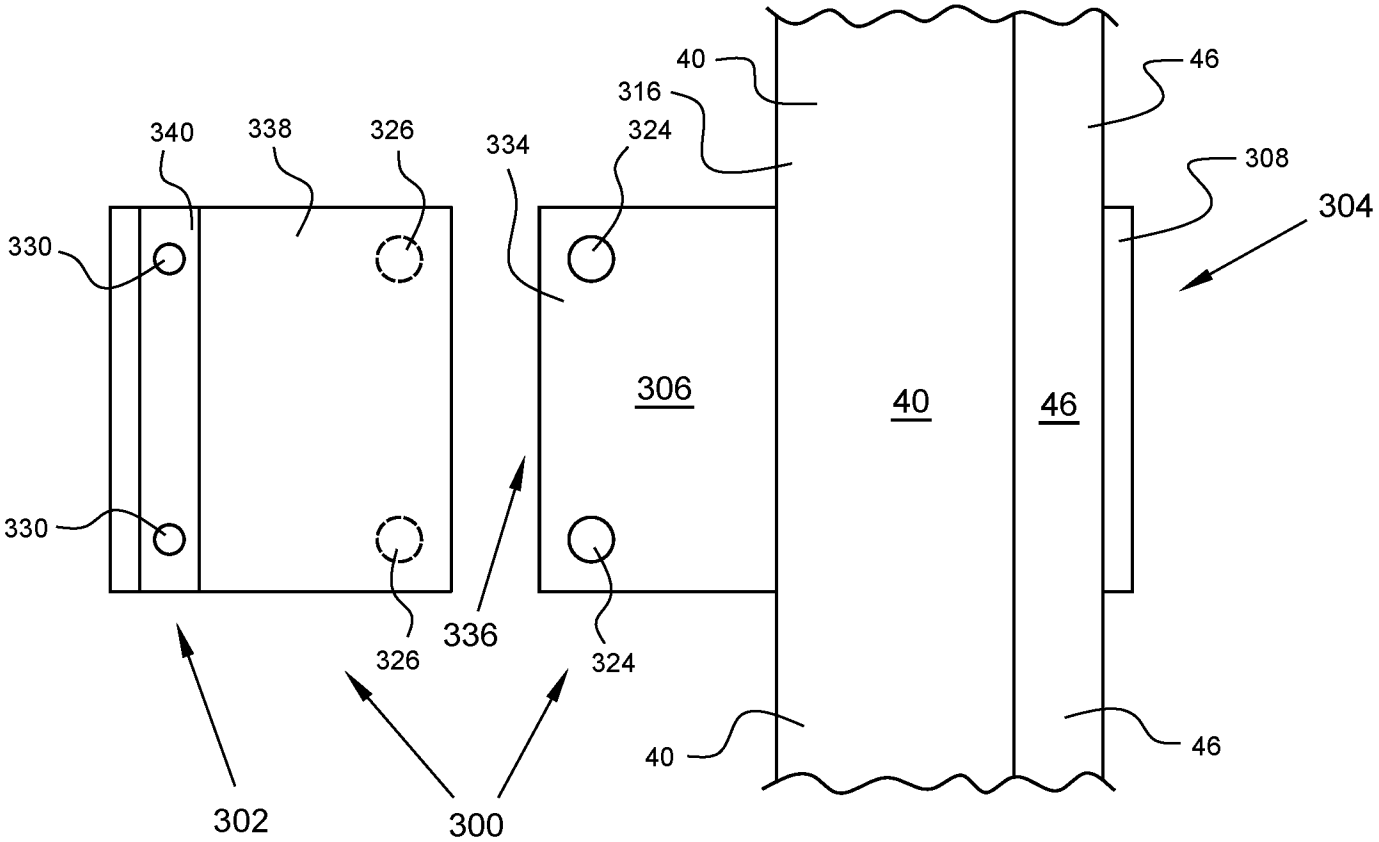
FIG. 17 is a top view of FIG. 16.
Figure 18:
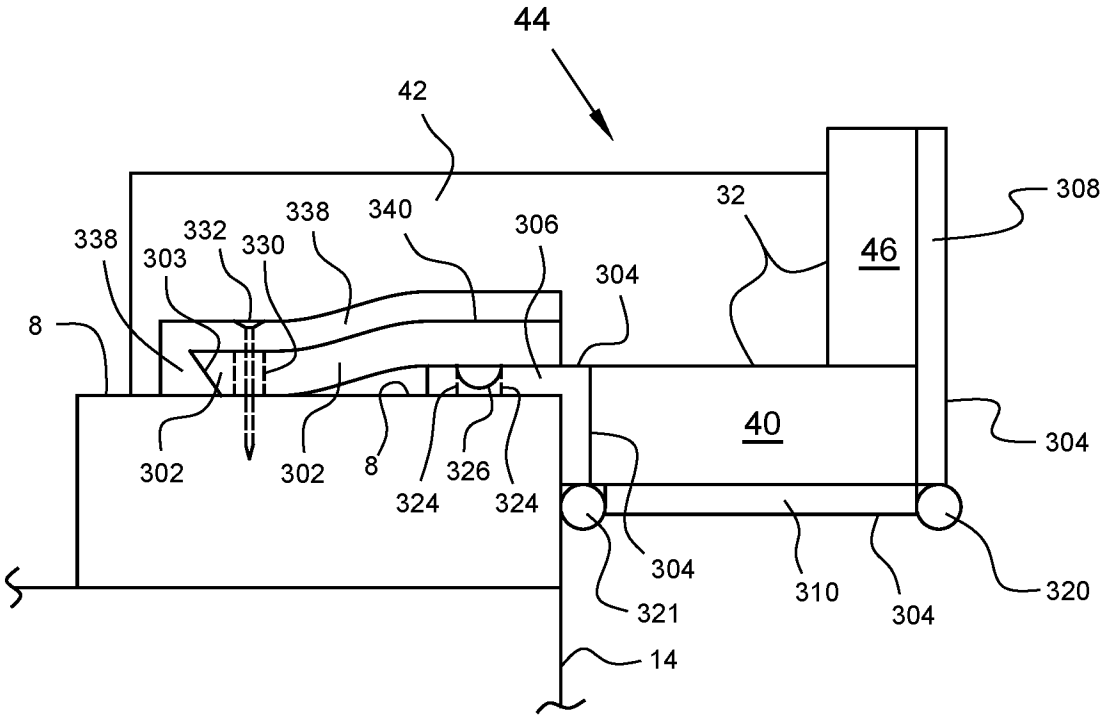
FIG. 18 is a left side elevation view of the fourth modified reusable pool mold disposed upon and secured to a concrete walking surface, whereby, multiple fourth modified reusable pool mold bracket members secured to cooperating locking tab members support form members above a peripheral portion of pool water in accordance with the present invention.

Referring now to FIGS. 16-18, a fourth modification to the reusable pool mold 10 is depicted for forming swimming pool overhangs 44 in accordance with the present invention and is denoted as numeral 300. The fourth modified mold 300 includes a locking tab member 302 detachably secured to and disposed above an inner horizontal plate member 306 of a bracket member 304. The locking tab member 302 and the bracket member 304 are fabricated preferably from relatively thin, substantially rectangular portions of bendable steel. Alternatively, the members 302 and 304 can be fabricated from, but not limited to, polyurethane, stainless steel, wood and similarly relatively rigid but bendable materials. The configuration and dimensions of the locking tab and bracket members 302 and 304 depend upon the dimensions of the overhang 44, the weight of the deformable material 42 and the distance separating adjacent molds 300. The methods for configuring and dimensioning the locking tab and bracket members 302 and 304 are well known to those of ordinary skill in the art.

The mold 300 further includes a form member 32 detachably secured to an outer vertical plate member 308 and an outer horizontal plate member 310 of the bracket member 304. The form member 32 includes a first form member 40 that is generally a horizontal 2×4 wood (or similar sized, non-deformable material) form that supports a bottom portion of a deformable material (concrete) 42 overhang 44.

The form member 32 further includes a second form member 46 that is generally a vertical 2×4 wood form 46 disposed upon and cooperating with the horizontal form 40 to continuously extend above a peripheral water portion of the pool 13. The horizontal wood form 40 is detachably secured to the outer horizontal plate member 310 via wood screws or similar fasteners 48, and the vertical wood form 46 is detachably secured to the outer vertical plate member 308 via fasteners 50. The form member 32 receives a deformable material 42 that ultimately solidifies; whereby, the form member 32 configures a continuously extending overhang 44 above a peripheral portion of water surface inside the pool 13.

Although the first and second form members 40 and 46 are described as wood 2×4's, the form members 40 and 46 can be dimensioned to measurements less than an inch or greater than four inches depending upon the user's requirements to achieve a predetermined coping or overhang 44 configuration. The form members 40 and 46 can be fabricated from a myriad of materials, including but not limited to polymers, aluminum, stainless steel, galvanized steel and powder coat steel. Further, the locking tab and bracket members 302 and 304 may be fabricated from the materials as the form members 40 and 46, and can be dimensioned to support the dimensions and weight of the form members 40 and 46 plus the weight of a predetermined quantity and type of deformable material used to form the coping or overhang 44.

The bracket members 304 further include an inner vertical plate member 312 integrally joined to the inner horizontal and outer horizontal plate members 306 and 310, whereby, a top horizontal wall 314 of the inner horizontal plate member 306 is vertically below the top wall 316 elevation of the horizontal form 40 after the form 40 is detachably secured to the top wall 318 of the outer horizontal plate member 310. The outer vertical plate member 308 includes a lower portion rotationally secured to an outer portion of the outer horizontal plate member 310 via a hinge member 320. The hinge member 320 allows the outer vertical plate member 308 to pivot one hundred and eighty degrees to a vertically downward position 322 after deformable material 42 has solidified and after the securing screw 50 is removed from the vertical form member 46.

The inner horizontal portion 306 of the bracket member 304 includes at least one and preferably two apertures 324 dimensioned to receive cooperating "dimples" or "hemisphere" configured protrusions 326 extending from a bottom wall 328 of the locking tab member 302. The locking tab member 302 includes at least one and preferably two securing apertures 330 for receiving securing screws 332 that ultimately penetrates the surface 8 of the concrete walking area disposed about the swimming pool 13. The securing screws 332 maintain the position of a portion of the bottom wall 328 of the locking tab member 302 upon a cooperating portion of a top wall 334 of the inner horizontal member 306 of the bracket member 304, whereby, the protrusions 326 are snugly inserted into the apertures 324, thereby cooperating with the securing screws 332 to maintain the position of the locking tab member 302 upon the surface 8 of the concrete walking area and upon an inner portion 336 of the inner horizontal portion 306 when deformable material 42 is disposed upon the form member 32.

The fourth modification mold 300 further includes a relatively thin layer of Styrofoam or similar deformable material that forms a compression layer 338 disposed upon and secured to a top wall 340 of the locking tab member 302. The compression layer 338 promotes separation between the deformable material 42 disposed upon the mold 300 and the top wall 340 of the locking tab member 302; whereby, after the deformable material 42 solidifies and the form member 32 removed from the overhang 44 by pivoting the outer vertical plate member 308 to a downward position 332, the inner horizontal plate member 306 is forcibly and horizontally slid from between the solidified material 42 and the top wall 8 of the concrete, resulting in the bracket member 304 being reused for another pool project and the encasement of the locking tab member 302 in the deformable material 42.

The removal of the bracket member 304 is achieved via the horizontal motion of the inner horizontal plate member 306 urging the relatively round dimple 326 of the locking tab member 302 vertically upward, resulting in the "squeezing" of the compression layer 338 between the solidified material 42 and the top wall 340 of the locking tab member 302, thereby enabling the horizontal sliding and forcible removal of the inner horizontal plate member 306 from between the deformable material 42 and the top surface 8 of the concrete walking area disposed about the swimming pool 13. The required lineal horizontal sliding distance of the inner horizontal plate member 306; whereby, the horizontal plate member 306 frictionally engages the deformable material 42 and the top surface 8 of the concrete walking area is between two and three inches when using 2×4s for the form member 32, resulting in a relatively easy extraction of the inner horizontal plate member 306 and the bracket member 304. The locking tab member 302 remains encased in the solidified deformable material 42 after the bracket member 304 is removed.

Referring to FIG. 18, a second hinge 321 is included with a locking feature to maintain the position of the outer horizontal plate member 310 when the first form member 40 is attached to the plate member 310 and deformable material 42 disposed upon the first form member 40. The second hinge 321 pivots the outer horizontal plate member 310 to a substantially vertically downward position, thereby enabling the first form member 40 to be lowered from solidified deformable material 42 instead of horizontally slid from between the solidified material 42 and the plate member 310. The second hinge 321 is well known to those of ordinary skill in the art.

FIG. 18 further includes a locking tab member 302 having an angled inner end 303 for enabling the compression layer 338 to be extended, whereby, the layer 338 is disposed under the inner end 303 for promoting the upward motion of the dimple 326 of the locking tab member 302 and a relatively slight downward motion of the angled inner end 303 of the locking tab member 302, thereby reducing the required force to elevate the dimple 326 and locking tab member 302, resulting in a reduction of the manual force required to horizontally slide the inner horizontal plate member 306 from between the solidified deformable material 42 and the top surface 8 of the concrete walking area disposed about the swimming pool 13. An alternative to the angled inner end 303, is a trapezoidal configured end adjacent to securing aperture 330 as depicted in FIG. 16.

The foregoing description is for purpose of illustration only and is not intended to limit the scope of protection accorded this invention. The scope of protection is to be measured by the following claims, which should be interpreted as broadly as the inventive contribution permits.

The invention claimed is:

1. A reusable pool mold for forming an overhang over pool water comprising:

multiple bracket members detachably secured to a continuously extending liner receiver for a swimming pool, each of said bracket members having a lower portion of an outer vertical member joined to an outer portion of a horizontal member, and having an inner portion of said horizontal member joined to an upper portion of an inner vertical member;

a securing member for each of said multiple bracket members for detachably securing said multiple bracket members to the continuously extending liner receiver, said securing member including a configuration that cooperates with said inner vertical member of each of said multiple bracket members for capturing a jaw member of the continuously extending liner receiver, whereby a lower vertical side wall portion of said securing member engages an inner wall portion of the jaw member of the continuously extending liner receiver; and a form member detachably secured to said bracket members, said form member continuously extending above a peripheral portion of water in a swimming pool, said form member receiving deformable material that ultimately solidifies; whereupon, said form member, said securing member and said bracket members are removed from the continuously extending liner receiver and the solidified material to reveal a configured overhang continuously extending above a peripheral portion of water inside the swimming pool.

2. The reusable pool mold of claim 1 wherein said inner vertical member includes a relatively small horizontal portion integrally joined to a relatively rigid securing member.

3. The reusable pool mold of claim 1 wherein said securing member includes a substantially triangular configuration for detachably securing said inner vertical member to the liner receiver via a recess in the liner receiver, said securing member configuration promoting insertion of said securing member inside the recess in the liner receiver, and preventing the removal of said securing member from the liner receiver when the deformable material is disposed upon said form member.

4. The reusable pool mold of claim 1 wherein said securing member is forcibly urged into a recess in the liner receiver and ultimately positioned; whereby, said lower vertical side wall portion of said securing member engaging said inner wall portion of the jaw member of the liner receiver, includes a lower portion of a horizontal portion of said inner vertical member congruently engaging a top wall of the jaw member, thereby maintaining the position of said securing member inside the recess and maintaining engagement of said inner vertical member against both a vertical wall of a swimming pool and the jaw member, irrespective of deformable material being disposed upon said reusable pool mold.

5. The reusable pool mold of claim 1 wherein said securing member is maintained in the recess of the liner receiver, irrespective of an end portion of a swimming pool liner being disposed in the recess.

6. A reusable pool mold for forming an overhang over pool water comprising:

multiple bracket members detachably secured to a continuously extending liner receiver for a swimming pool, each of said bracket members having a lower portion of an outer vertical member joined to an outer portion of a horizontal member, and having an inner portion of said horizontal member joined to an upper portion of an inner vertical member, said multiple bracket members being formed from said outer vertical member having a lower portion rotationally secured to said outer portion of said horizontal member;

a securing member for each of said multiple bracket members for detachably securing said multiple bracket members to the continuously extending liner receiver, said securing member including a configuration that cooperates with said inner vertical member of each of said multiple bracket members for capturing a jaw member of the continuously extending liner receiver; and a form member detachably secured to said bracket members, said form member continuously extending above a peripheral portion of water in a swimming pool, said form member receiving deformable material that ultimately solidifies; whereupon, said form member, said securing member and said bracket members are removed from the continuously extending liner receiver and the solidified material to reveal a configured overhang continuously extending above a peripheral portion of water inside the swimming pool.

7. The reusable pool mold of claim 6 wherein said lower portion of said outer vertical member can be rotationally secured to said outer portion of said horizontal member via a hinge member for pivoting said outer vertical member about one hundred and eighty degrees to a substantially vertically downward position.

8. A reusable pool mold for forming an overhang over pool water comprising:

multiple bracket members detachably secured to a continuously extending liner receiver for a swimming pool, each of said bracket members having a lower portion of an outer vertical member joined to an outer portion of a horizontal member, and having an inner portion of said horizontal member joined to an upper portion of an inner vertical member;

a relatively rigid securing member for each of said multiple bracket members for detachably securing said multiple bracket members to the continuously extending liner receiver, said securing member including a configuration that cooperates with said inner vertical member of each of said multiple bracket members for capturing a jaw member of the continuously extending liner receiver, said inner vertical member including a relatively small horizontal portion integrally joined to said relatively rigid securing member, said securing member being fabricated from a relatively hard deformable rubber; and a form member detachably secured to said bracket members, said form member continuously extending above a peripheral portion of water in a swimming pool, said form member receiving deformable material that ultimately solidifies; whereupon, said form member, said securing member and said bracket members are removed from the continuously extending liner receiver and the solidified material to reveal a configured overhang continuously extending above a peripheral portion of water inside the swimming pool.

9. A reusable pool mold for forming an overhang over pool water comprising:

multiple bracket members detachably secured to a continuously extending liner receiver fora swimming pool, each of said bracket members having a lower portion of an outer vertical member joined to an outer portion of a horizontal member, and having an inner portion of said horizontal member joined to an upper portion of an inner vertical member;

a securing member for each of said multiple bracket members for detachably securing said multiple bracket members to the continuously extending liner receiver, said securing member including a configuration that cooperates with said inner vertical member of each of said multiple bracket members for capturing a jaw member of the continuously extending liner receiver, whereby a lower vertical side wall portion of said securing member engages an inner wall portion of the jaw member of the continuously extending liner receiver; and a form member detachably secured to said bracket members, said form member including a first form member that is horizontally disposed and supports a bottom portion of a deformable material overhang, said first form member engaging the liner receiver, whereby, the deformable material is prevented from entering a recess of the continuously extending liner receiver, thereby enabling the manual removal of said securing member from the recess, said form member continuously extending above a peripheral portion of water in a swimming pool, said form member receiving deformable material that ultimately solidifies; whereupon, said form member, said securing member and said bracket members are removed from the liner receiver and the solidified material to reveal a configured overhang continuously extending above a peripheral portion of water inside the swimming pool.

10. The reusable pool mold of claim 9 wherein said first form member is detachably secured to said horizontal member.

11. The reusable pool mold of claim 10 wherein said form member includes a second form member that is vertically disposed upon and cooperating with said first form member to continuously extend above the peripheral portion of water inside the swimming pool, said second form member being detachably secured to said outer vertical member; whereby, said first and second form members cooperate to receive a deformable material that ultimately solidifies, thereby configuring a continuously extending overhang over the peripheral portion of water after the reusable pool mold is removed from the liner receiver.

12. The reusable mold of claim 11 wherein said first form member includes a protrusion portion that forms a first vertical inner side wall that engages the upper front wall portion of the liner receiver and a top wall of the horizontal portion of the vertical plate member, whereby deformable material is prevented from entering the liner receiver recess.

13. The reusable mold of claim 12 wherein said protrusion portion includes a second vertical inner side wall that engages an upper portion of said inner vertical member, said protrusion portion including a first horizontal inner bottom wall that engages a top wall of said horizontal portion of said inner vertical member, thereby securing the position of said first form member relative to the liner receiver and said inner vertical member when said securing member is inserted into the liner receiver recess.

14. The reusable mold of claim 13 wherein said protrusion portion secures engagement between the upper front wall portion of the liner receiver and the first form member when said securing member is lowered inside the recess of the liner receiver until a lower portion of said horizontal portion of said inner vertical member engages a top wall of the jaw member, and a bottom wall of said securing member engages a bottom wall of the recess, resulting in the capture of the jaw member between a lower vertical wall of said securing member and said inner vertical member.

15. The reusable mold of claim 14 wherein said captured jaw member maintains said securing member inside the liner receiver recess and maintains the position of said bracket relative to the swimming pool wall when deformable material is disposed upon said first and second form members to ultimately configure an overhang over a selected peripheral portion of water in the swimming pool, whereby, a bottom wall of the overhang is aligned with a top wall of the liner receiver.

16. A reusable swimming pool mold for forming a coping over pool water comprising:

multiple bracket members detachably secured to corresponding bracket retainers for a swimming pool, each of said bracket members having a lower portion of an outer vertical member integrally joined to an outer portion of a horizontal member, and having an inner portion of said horizontal member integrally joined to an upper portion of an inner vertical member;

a securing member for each of said multiple bracket members for detachably securing said multiple bracket members to the corresponding bracket retainer, said securing member including a configuration that cooperates with said inner vertical member of each of said multiple bracket members to for capturing a jaw member of the corresponding bracket retainer; whereby a lower vertical side wall portion of said securing member engages an inner wall portion of the jaw member of the corresponding bracket retainer, and a lower portion of a horizontal portion of said inner vertical member engages a top wall of the jaw member; and a form member detachably secured to said bracket members, said form member continuously extending above a water portion of a swimming pool, said form member receiving deformable material that ultimately solidifies; whereby, said form member configures a continuously extending coping above a water surface inside the swimming pool, whereupon, said form member, said securing member and said bracket members are removed from the liner receiver and the solidified material to reveal a configured coping continuously extending above a peripheral portion of water inside the swimming pool.

17. The reusable pool mold of claim 16 wherein said bracket members are formed from an outer vertical member having a lower portion rotationally secured to an outer portion of a horizontal member.

18. The reusable pool mold of claim 16 wherein said securing member includes a substantially right-triangle configured rigid rubber material for detachably securing said inner vertical member to said bracket retainer via a recess in said bracket retainer, said securing member configuration promoting insertion of said securing member inside said recess in said bracket retainer, and preventing the removal of said securing members from said bracket retainer when deformable material is disposed upon said form member.

19. The reusable pool mold of claim 16 wherein said securing member is fabricated from a relatively hard deformable rubber and includes a substantially triangular configuration for forcibly urging said securing member into a recess in said corresponding bracket retainer, thereby maintaining the position of said securing member inside said recess and maintaining engagement of the inner vertical member against a vertical wall of a swimming pool.

20. A reusable pool mold comprising:

multiple bracket members detachably secured to a continuously extending liner receiver for a swimming pool, each of said bracket members having a lower portion of an outer vertical member rotationally joined to an outer portion of a horizontal member, and having an inner portion of said horizontal member integrally joined to an upper portion of an inner vertical member;

a securing member for each of said multiple bracket members for detachably securing said multiple bracket members to the continuously extending liner receiver, said securing member including a configuration that cooperates with said inner vertical member of each of said multiple bracket members for capturing a jaw member of the continuously extending liner receiver, said securing member being forcibly urged into a recess in the continuously extending liner receiver and ultimately positioned; whereby, a lower vertical side wall portion of said securing member engages an inner wall portion of the jaw member of the continuously extending liner receiver, and a lower portion of a horizontal portion of said inner vertical member congruently engages a top wall of the jaw member, thereby maintaining the position of said securing member inside the recess and maintaining engagement of said inner vertical member against both a vertical wall of a swimming pool and the jaw member, irrespective of deformable material being disposed upon said reusable pool mold; and a form member detachably secured to said bracket members, said form member continuously extending above a peripheral portion of water in a swimming pool, said form member receiving deformable material that ultimately solidifies; whereupon, said form member, said securing member and said bracket members are removed from the liner receiver and the solidified material to reveal a configured overhang continuously extending above a peripheral portion of water inside the swimming pool.

* * * * *